US012774058B1

(12) United States Patent
Logan

(10) Patent No.: US 12,774,058 B1
(45) **Date of Patent: *Oct. 27, 2026**

(54) MOORING DEVICE AND METHODS OF USE

(71) Applicant: Scott Logan, Arroyo Grande, CA (US)

(72) Inventor: Scott Logan, Arroyo Grande, CA (US)

( * ) Notice: Subject to any disclaimer, the term of this patent is extended or adjusted under 35 U.S.C. 154(b) by 758 days.

This patent is subject to a terminal disclaimer.

(21) Appl. No.: 18/132,956

(22) Filed: Apr. 10, 2023

Related U.S. Application Data

(63) Continuation-in-part of application No. 17/686,426, filed on Mar. 4, 2022, now Pat. No. 11,884,366, which is a continuation of application No. 17/390,549, filed on Jul. 30, 2021, now Pat. No. 11,319,029.

(60) Provisional application No. 63/329,457, filed on Apr. 10, 2022, provisional application No. 63/058,899, filed on Jul. 30, 2020.

(51) Int. Cl.
*B63B 21/00* (2006.01)

(52) U.S. Cl.
CPC ..... *B63B 21/00* (2013.01); *B63B 2021/004* (2013.01)

(58) Field of Classification Search
CPC ... B63B 21/00; B63B 2021/004; B63B 21/20; B63B 2021/203
See application file for complete search history.

(56) References Cited

U.S. PATENT DOCUMENTS

| | | | |
|---|---|---|---|
| 3,108,563 | A | 10/1963 | Wurdack |
| 5,361,716 | A | 11/1994 | Cotton |
| 5,499,591 | A | 3/1996 | Chippas |
| 5,634,421 | A | 6/1997 | Velarde |
| 5,676,085 | A | 10/1997 | Michl, Jr. |
| 7,827,924 | B1 | 11/2010 | Perez |
| 8,091,499 | B1 | 1/2012 | Perez |
| 9,505,465 | B2 | 11/2016 | Wright |
| 2007/0289518 | A1 | 12/2007 | Lawson |
| 2015/0307159 | A1 | 10/2015 | Jain |
| 2021/0214047 | A1 | 7/2021 | Gonzales |

FOREIGN PATENT DOCUMENTS

| | | | |
|---|---|---|---|
| ES | 2328568 | T3 | 11/2009 |

OTHER PUBLICATIONS

English machine translated abstract of Spanish Application No. ES2328568 reteived Jul. 29, 2021 from "https://translationportal.epo.org/emtp/translate/?ACTION=abstract-retrieval&COUNTRY=ES&ENGINE=google&FORMAT=docdb&KIND=T3&LOCALE=en_EP&NUMBER=2328568&SRCLANG=es&TRGLANG=en".

*Primary Examiner* — Anthony D Wiest
(74) *Attorney, Agent, or Firm* — Sierra IP Law, PC; William K. Nelson

(57) ABSTRACT

The present invention provides an improved device for attaching a watercraft to another structure such as another watercraft or a fixed structure, such as a dock. The apparatus comprises a spacing bar and specialized, quick connecting and releasing attachment devices that allow the watercraft to be quickly and effectively moored to other structures on the water without the risk of collision or damage to the watercraft. The quick-connect devices may be positioned near ends of the spacing bars to effectively hold the watercraft at a predetermined distance from the other structure. The device may further include tensioning mechanisms that are operable to keep the spacing bars at a substantially orthogonal orientation relative to the watercraft to maintain the pre-determined spacing between the watercraft and the other structure.

20 Claims, 18 Drawing Sheets

MOORING DEVICE AND METHODS OF USE

FIELD OF THE INVENTION

The present invention relates to novel mooring devices for attaching a watercraft to other structures. More particularly, embodiments of the present invention pertain to a device that is operable to provide spacing between a watercraft and another structure to which the device connects the watercraft.

DISCUSSION OF THE BACKGROUND

The use of watercraft, such as waterski boats, pontoon boats, fishing boats and the like is of increasing popularity. Often times, users like to attach their watercraft to other watercraft for various purposes such, as socializing and meals, while floating on a body of water. It is desirable to be able to moor two watercraft together in order to allow proximity in the open water for social purposes or to facilitate communication and the coordination of efforts in research and fishing endeavors. Attaching one floating watercraft to another is referred to as rafting. While the rafted watercraft float on the body of water, they are subject to waves, the wakes of other boats, tides, and currents that can cause the rafted watercraft to move relative to each other. This relative movement increases the risk that the watercraft will contact each other and cause damage to one or both of the watercraft. The undulating of the watercraft, relative to the permanent structure, can cause the watercraft to contact the fixed structure, which may damage the watercraft.

Also, when moored to a fixed structure, such as a dock or pier, the watercraft are subject to the undulating surface of the water. Using a typical approach of ropes and bumpers may still leave a watercraft susceptible to damage caused by waves pushing the watercraft into the dock and the dock contacting the watercraft above the bumpers.

Conventional protective and cushioning devices can reduce damage to the hull of the boat due to motion caused by waves. However, bumpers or other padded devices do not prevent the relative movement of a watercraft to another craft or a dock, create difficulty in transferring people or items from a craft to another craft or dock, and are not entirely effective at limiting damage to the craft.

It is therefore desirable to provide a novel mooring device and related methods that address such issues.

SUMMARY OF THE INVENTION

The present invention relates to a mooring device for attaching two or more watercraft to each other, such as during rafting. The invention also generally relates to attaching a watercraft to a fixed structure, such as a dock.

The present invention also provides an apparatus and method of rafting two watercraft together or connecting a watercraft to a fixed structure (e.g., a dock) that can accommodate the movement of each watercraft relative to the other while preventing contact between the structures. The present invention further provides reliable connection mechanisms that maintain a fixed distance between the watercraft and the other craft or dock. The fixed distance prevents collisions between the watercraft and the other structure and provides a more stable relative position of the watercraft and the other structure to allow a person to move himself, cargo, or other material back and forth between the watercraft and the other structure with more confidence and surer footing.

The mooring device of the present invention includes two spacer bars that hold the watercraft from another watercraft or dock at a pre-determined distance, at least one cinching strap to hold the two spacer bars at an extended and parallel arrangement between the watercraft and other structure, and a quick connector mechanism. The spacer may have an adjustable length, e.g., having multiple concentric sections in a telescoping design that can be locked into a particular length with a locking pin. The present invention features a connection mechanism that allows for secure attachment of the end of each spacer bar to a cleat positioned on another vessel or a stationary structure (e.g., a dock), and quick attachment and release from the cleat.

The coupling mechanism may include features that are connected to the spacer bar and features that are attached to a vessel or stationary structure such as a dock. A joint having three degrees of rotational freedom may be in mechanical connection with one or both ends of each spacer bar (a "rotational joint"). For example, a ball-type joint may be positioned at of the ends of the spacer bar, allowing for the oscillations and movement of a vessel resulting from the undulation of the water. The rotational joint may be connected to a corresponding anchoring structure positioned on a vessel or stationary structure. The rotational joint allows for some play in the connection between the spacing member and the anchoring structure on a water craft or stationary structure to allow for the undulating motion of the vessel on the surface of the water. The rotational joint may allow for a movement and pivoting of the spacer bar relative to the rotational joint in any direction within a conical zone around a perpendicular to the outer surface of an anchoring structure of the mooring system (see, e.g, FIG. 11).

In one embodiment, the coupling mechanism may include a bracket mechanically connected to the rotational joint such that the bracket can rotate with the rotational joint as the watercraft moves with the undulations of the water. The bracket may include a locking pin for reversibly locking into a socket in a cleat fixed to a vessel or stationary structure. The rotational joint may be reversibly connected to an anchoring structure (e.g., a bracket or cleat) positioned on a vessel or stationary structure by the locking pin that passes through a hole in the rotational joint and one or more holes in the anchoring structure. For example, the rotational joint may have a cylindrical hole passing through a ball swivel, and the anchoring structure may be installed on the hull, gunwale, or other structure of a boat. The anchoring structure may include a receiver (e.g., a cavity, etc.) for receiving the rotational joint. The receiver may have one or more holes therein with which the hole in the ball swivel of the rotational joint may be aligned. In such embodiments, a locking pin may be positioned within the anchoring structure, nested in the recess, and movably engaged with the bracket.

The locking pin may be passed through the holes in the receiver and the rotational joint to couple the rotational joint to the anchoring structure. The locking pin may be a sliding pin mechanism that is guided along a path that passes through the holes in the receiver (and the rotational joint) and may be locked into place once engaged with the rotational joint. The locking mechanism may be a lever and slot mechanism, which includes a lever that is connected to the locking pin at an angel in a range of 70° to 110° relative to the length of the locking pin and a locking slot that is angled relative to the path of the locking pin in a range of 70° to 110°. In some embodiments, the anchoring structure may include an advancement slot that runs parallel to the path of the locking pin, and through which the lever passes when the locking pin is advanced through the holes in the receiver and the rotational joint. When the locking pin is advanced into the holes in the receiver and the rotational joint, the lever may reach the locking slot when the locking pin has passed through the holes in the receiver and the rotational joint. The lever may then be rotated into the locking slot to prevent the locking pin from sliding along the path or out of the holes in the receiver and the rotational joint. In such examples, the pin may have locked and unlocked positions within the recess. The rotational joint may be inserted into the bracket with the locking pin in the unlocked position and the hole in the rotational joint may be aligned with the hole(s) in the bracket. The locking pin may then be moved from the unlocked position, through the path, and passed through the holes in the rotational joint and the bracket to the locked position, thereby securing the rotational joint in the bracket. In other embodiments, the locking pin may include a retractable locking mechanism that will not release until a release mechanism has been activated (e.g., a button or switch), which retracts or releases a pin lock incorporated into the pin or the anchoring structure (e.g., a ball bearing, pins, bolts, or other protrusions) allowing the pin to pass through the holes without obstruction.

In some embodiments, the anchoring structure may be a recessed structure that is installed in the hull, gunwale or other accessible portion of a watercraft. The anchoring structure may have a recessed bracket into which the rotational joint maybe inserted, and an outer cover plate that is flush with the outer surface of the hull, gunwale, or other structure in the watercraft to avoid scratching, catching, or other problems that may occur if the anchoring structure protruded from the surface of the watercraft. The outer plate may be attached to the hull by anchors (e.g., screws) that are countersunk into the surface of the watercraft or the bracket to facilitate the flush installation. In some embodiments, a bracket on the anchoring structure may be positioned such that it protrudes from the anchoring structure, and the rotational joint and the locking pin are positioned above the anchoring structure when the rotational joint is coupled to the anchoring structure. In other examples, the bracket for receiving the rotational joint may be nested within the anchoring structure such that the rotational joint may be inserted into a recess in the anchoring structure to be aligned with the holes in the bracket.

In other embodiments, the locking pin may have a notch or slot (the "pin notch") that engages with an actuated locking pin, ball, or other protrusible structure (the "socket lock") that protrudes within the socket and engages the pin notch on the latch pin to hold the pin in place in the socket, preventing the latch pin from being pulled out of the socket. The latch pin and the socket may have complementary shapes, such that there is a tight fit between the latch pin and the socket that disallows slippage between the pin notch and the socket lock. The socket lock may be actuated by a pin or sleeve positioned in mechanical contact with the socket lock. For example, the socket lock may be engaged with a release pin, rod, or other structure (the "release mechanism") that moves in parallel to the receiver, having a groove operable to receive the socket lock and allow it to retract from the interior of the socket, releasing the latch pin from engagement with the socket. When the release mechanism is actuated or engaged, the groove therein may be positioned in alignment with the socket lock, allowing the socket lock to retract from the socket and into the groove. In some embodiments, the socket lock may be biased toward retracting into the groove (e.g., by a spring).

In some embodiments, both ends of each spacer bar may include a rotational joint for engagement with an anchoring structure. In some embodiments, the spacer bars may also include a hydraulic joint for cushioning the movement of one or more vessels attached to the spacer bar as they move due to undulations in the water. The spacer bars may each also include at least one connection point for a tensioning device for maintaining the spacer bars in a substantially parallel arrangement to prevent the vessel from colliding with the structure to which it is moored.

The tensioning device may provide an adjustable tension force between the two spacing bars. The tensioning device may include one or more tension straps operable to be connected to the connection points of the spacer bars. The tension device(s) may be configured in a criss-cross pattern between the spacer bars to create a stable parallel arrangement of the spacer bars. The tension device(s) may be connected to the spacer bars at the connection points on the spacer bars. The tension device(s) have a connection mechanism for connecting to the connection points on the space bars, such as a hook, a maillon, a carabineer, or other type of connector. The connection points on the spacer bars may be at or near each distal end thereof and may include a hook, ring or similar structure for engaging the connection mechanism of the tensioning device(s). The tensioning device(s) may comprise a portion that spans the distance between the spacer bars that may be cord, cable, or rope, e.g., made from braided or woven material. The tensioning device(s) may also include tightening mechanisms to selectively adjust the tension across the tensioning devices, such as cam buckles or ratchets that can increase or decrease the tension across the tension straps.

In other embodiments, the spacer bars may be extendable from a short, retracted positioned to a longer, extended position and may be fixed in the extended position to establish the spacing between the connected vessels (or a vessel and a static structure, like a dock). In such embodiments, the mooring system may include tethering lines (e.g., cords, cables, ropes, or other configured in criss-cross pattern between the spacer bars to create a stable parallel arrangement of the spacer bars. The tethers are connected to the spacer bars at distal ends of each spacer bar, such that a first tether is attached to a first end of a first spacer bar and a second tether is attached to a second end of the first spacer bar, and the second tether is attached to a first end of a second spacer bar and the first tether is attached to a second end of the second spacer bar. In such embodiments, the tethering lines have a fixed length and are tensioned by the extension of the spacer bars to the extended position, thereby increasing the distance between the attachment points of the tethers. The first and second tethers are tight when the spacer bars in extended position and create stability in the system and the first and second spacer bars are held in parallel configuration, stably holding the two vessels (or a vessel and a static structure, like a dock) at distance equal to the length of the extended spacer bars. For example, the anchoring structures may be spaced apart along the hulls of two vessels at a distance of 14 feet, the extended lengths of the spacing bars may both be 24 inches, and the lengths of the tethering members may both be 169 inches, providing right triangle arrangements of the spacer bar, hull, and tether member. The length of the extended spacer bars may be in a range of about 18 inches to about 36 inches (e.g., about 20 inches to about 30 inches, about 24 inches, or any value therein). The length of the spacer bars in the retracted position may be in a range of about 10 inches to about 20 inches (e.g., about 12 inches to about 18 inches, about 15 inches, or any value therein).

The lengths of the tether members may be in a range of about 125 inches and about 195 inches. The spacing of the anchor structures on a hull may be in a range of about 10 feet to about 15 feet.

The spacer bars may have multiple concentric sections in a telescoping design that can be extended or retracted by sliding their relative positions. The telescoping sections can be locked into an extended position of a pre-determined length with a locking mechanism (e.g., a spring-biased locking pin). In some embodiments, the telescoping spacer bars may have multiple length settings that allow for mooring a vessel at varying distances from another vessel or static structure (e.g., a dock). In such embodiments, the tensioning system may include tethering members of different lengths that can be used with different extended settings of the spacer bars.

The anchoring structures may be part of a novel cleat structure that provides the functionality of a traditional cleat, as well as the connection point for the rotational joints of the spacer bars. The cleat may include a socket for receiving a locking pin from the rotational joint or may have a bracket to receive the rotational joint and receive a pin. The brackets on the cleat may also function as a cleat. For example, the cleat structure may be attached to the bracket, allowing a conventional mooring rope to be fastened to the bracket. In other embodiments, the anchoring structures may simply comprise brackets for receiving the rotational joint that are attached to a vessel or a dock or other stationary structure.

It is an object of the present invention to provide improved mooring devices to protect boats and vessels from collision and damage.

It is also an object of the present invention to provide a mooring device that maintains the vessel at a safe distance from a pier or dock in varying conditions of wind, current, tide and waves.

It is also an object of the present invention to provide a mooring device that can be promptly installed and removed from a pier and/or dock.

Additional aspects and objects of the invention will be apparent from the detailed descriptions and the claims herein.

DETAILED DESCRIPTION

Figure 1:
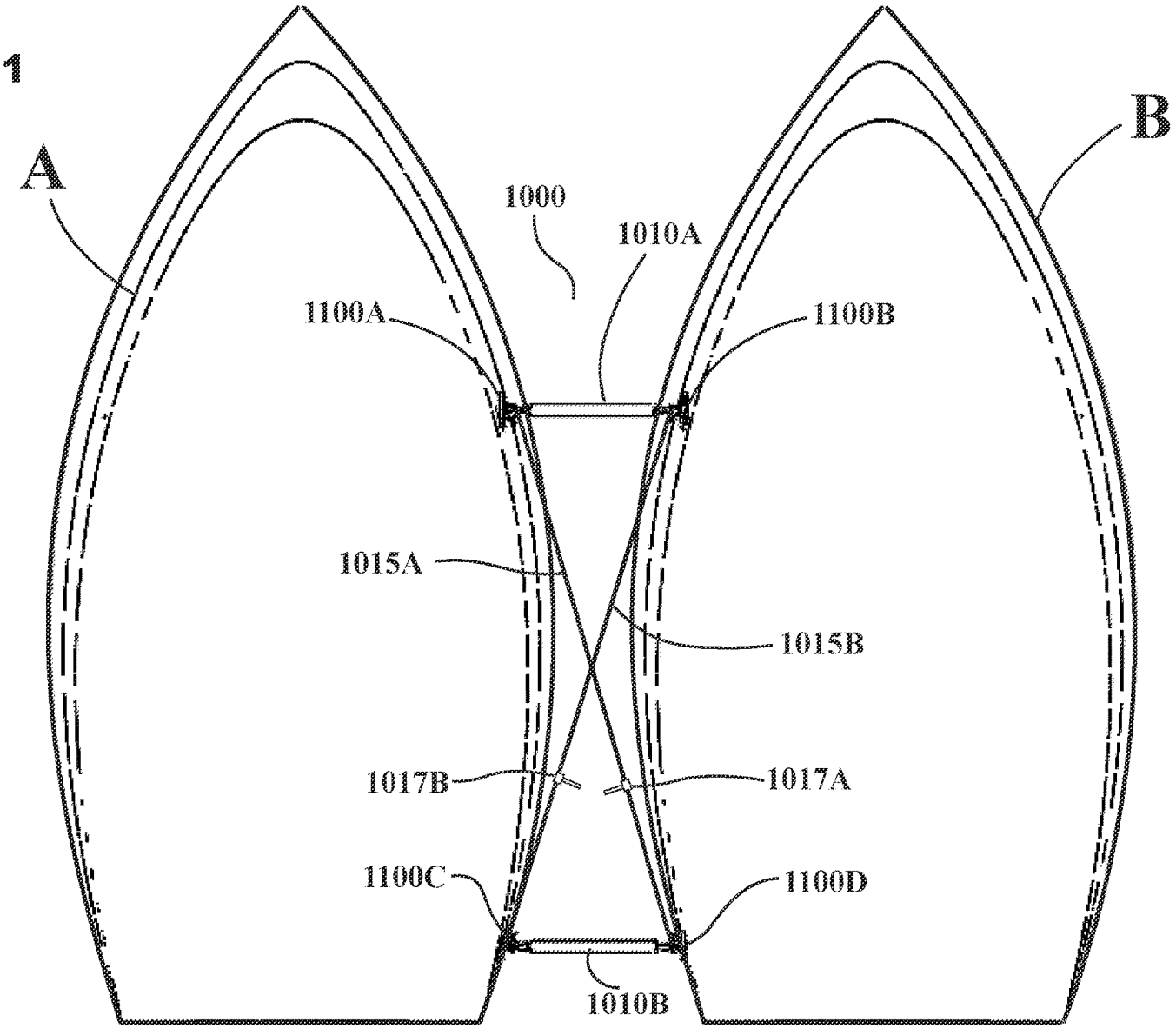
FIG. 1 provides a bottom view of two watercraft connected by a mooring system, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

Referring to the drawings wherein like reference characters designate like or corresponding parts throughout the several views, and referring to FIGS. 1-12B, it is seen that the present invention includes various embodiments of a watercraft mooring and rafting system that holds the watercraft at a substantially constant distance from another watercraft, dock, or other structure and prevents collision between them.

Figure 2:
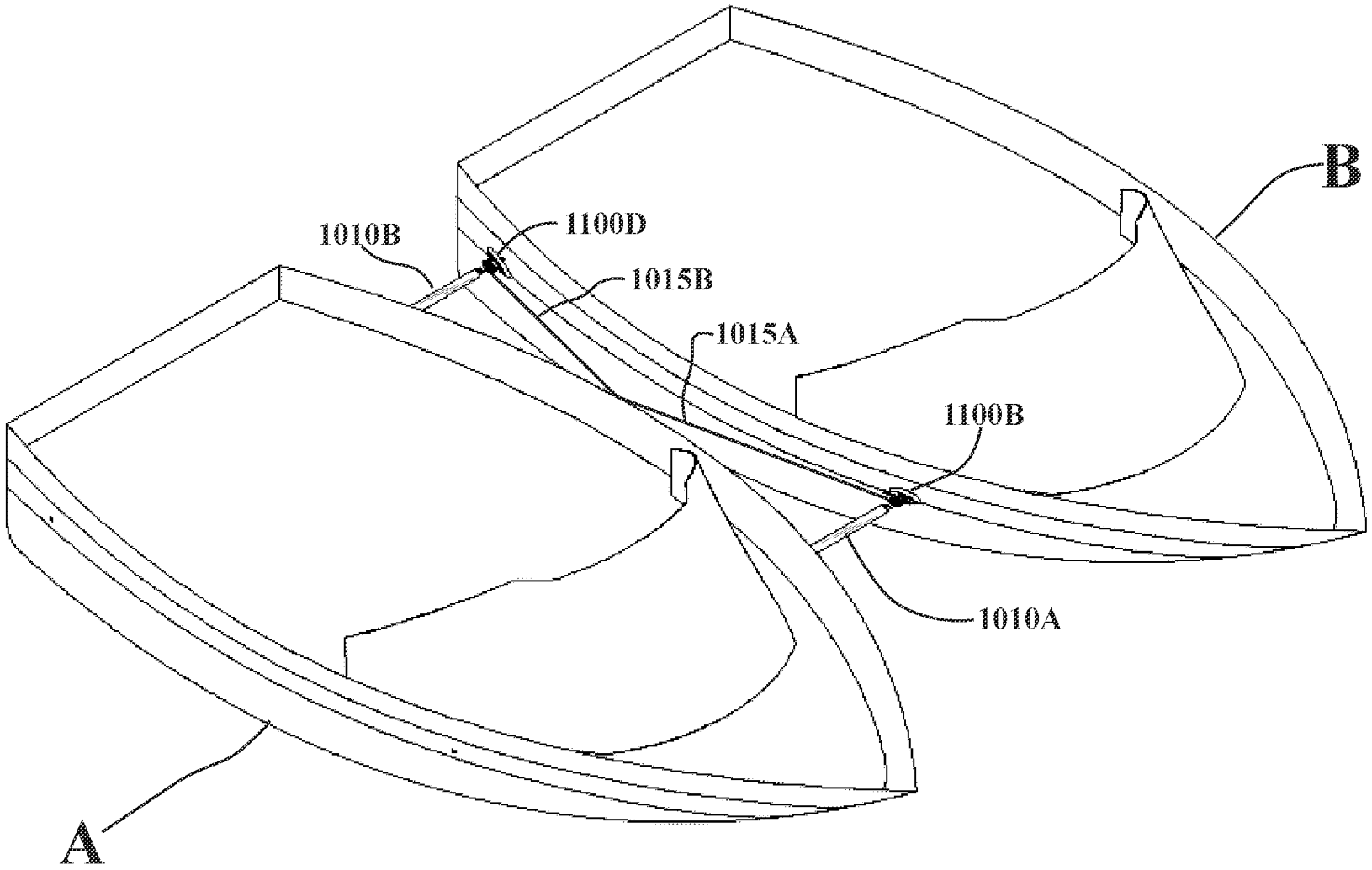
FIG. 2 provides a perspective view of two watercraft connected by a mooring system, according to an embodiment of the present invention.

FIGS. 1-2 provide environmental views of one application of the mooring system 1000 of the present invention. The views in the drawings show the mooring system 1000 connecting two vessels A and B at a fixed distance to one another, spaced apart by the spacing members 1010A and 1010B. The spacing members 1010A and 1010B are attached to the vessels A and B via the anchoring structures 1100A, 1100B, 1100C, and HOOD attached to the hull of each vessel A and B, each vessel having two anchoring structures at a predetermined distance from one another along the hull and at substantially the same vertical distance from the keel thereof. This arrangement may be substantially the same on both vessels to allow for substantially parallel positioning of the spacing members 1010A and 1010B in both the vertical and horizontal aspects. The spacing members 1010A and 1010B are held in a substantially parallel position by the tensioning members (e.g., straps or cords) 1020A and 1020B connected to at each end to one of the spacing members 1010A or 1010B in a criss-cross pattern. The tensioning members 1015A and 1015B prevent the spacing members 1010A and 1010B from deviating from their substantially parallel arrangement and the vessels A and B from sliding past one another.

Figure 3:
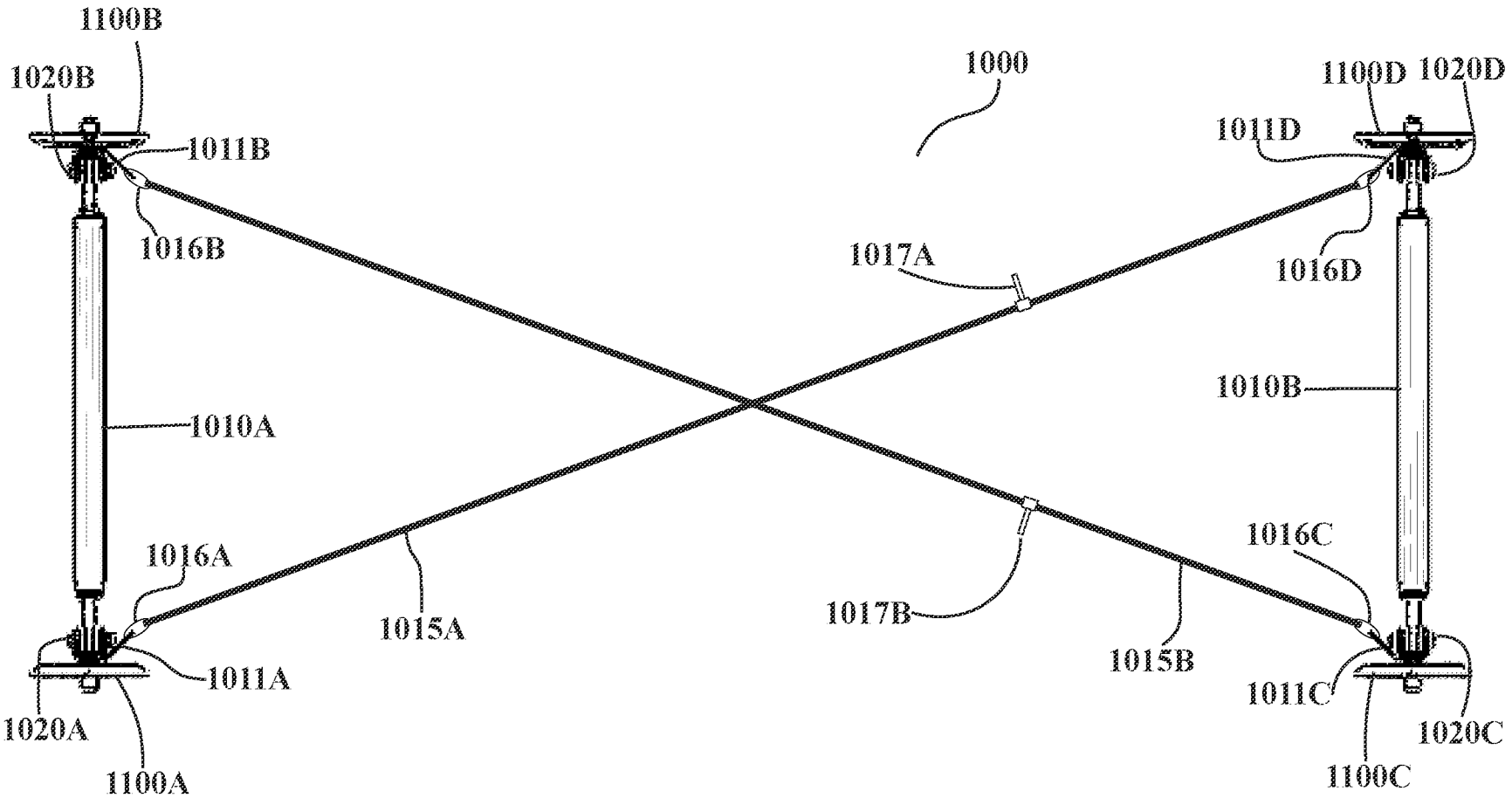
FIG. 3 provides a view of a mooring system, according to an embodiment of the present invention.

FIG. 3 shows a close-up arrangement of the mooring system 1000, with the spacing members 1010A and 1010B at a predetermined distance from one another in a substantially parallel arrangement. The tensioning members 1015A and 1015B (e.g., straps or cords) are connected at each end to one of the spacing members 1010A and 1010B in a criss-cross pattern to stabilize the system 1000. Each anchoring structure 1100A, 1100B, 1100C, and 1100D includes an attachment point for connecting to one end of one of the tensioning members 1015A and 1015B. For example, each anchoring structure may include a ring or rigid loop structure to which the tensioning member can be connected. Anchoring structure 1100A includes an attachment point 1011A, anchoring structure 1100B includes an attachment point 1011B, anchoring structure 1100C includes an attachment point 1011C, and anchoring structure 1100D includes an attachment point 1011D. Each tensioning member 1015A, 1015B may include a connector at each end thereof for attaching to one of the attachment points 1011A, 1011B, 1011C, and 1011D. Tensioning member 1015A includes connectors 1016A and 1016D, and tensioning member 1015B includes connectors 1016B and 1016C. The connector may be a clip such as a carabiner clip, mountaineer's clip, D-clip a round-eye swivel snap, or other appropriate attachment mechanism fixedly connected to a distal end of one of the tensioning members 1015A and 1015B. The tensioning members may be a strap, cord, or wire (e.g., a woven strap, cord or wire) that comprises a high tensile strength material, such as nylon, steel (e.g., high strength alloy ASTM A514), high-density polyethylene (HDPE), polypropylene, polyester resin, polyamide thermoplastic, and other appropriate materials. In some embodiments, each of the tensioning members 1015A and 1015B may include a tensioning device for increasing the tension in the tensioning member, e.g., once it is attached to the anchoring structures. The tensioning devices may be a ratcheting mechanism, a rigging screw, turnbuckle, tension buckle, or other appropriate tensioning device for a strap, cord, or wire. Tensioning member 1015A may include a tensioning device 1017A and tensioning member 1015B may include tensioning device 1017B.

The anchoring structures 1100A, 1100B, 1100C, and 1100D are connected to the rotational joints 1020A, 1020B, 1020C, and 1020D of the spacing members 1010A and 1010B by a reversibly locking mechanism that provides for efficient attachment and detachment of the system spacing members 1010A and 1010B from the anchoring structures 1100A, 1100B, 1100C, and 1100D and thus the vessels A and B. It shall be understood that the anchoring structures are operable to be connected to a stationary structure, such as a dock, allowing the mooring system 1000 to connect a watercraft to such stationary structure.

Figure 3A:
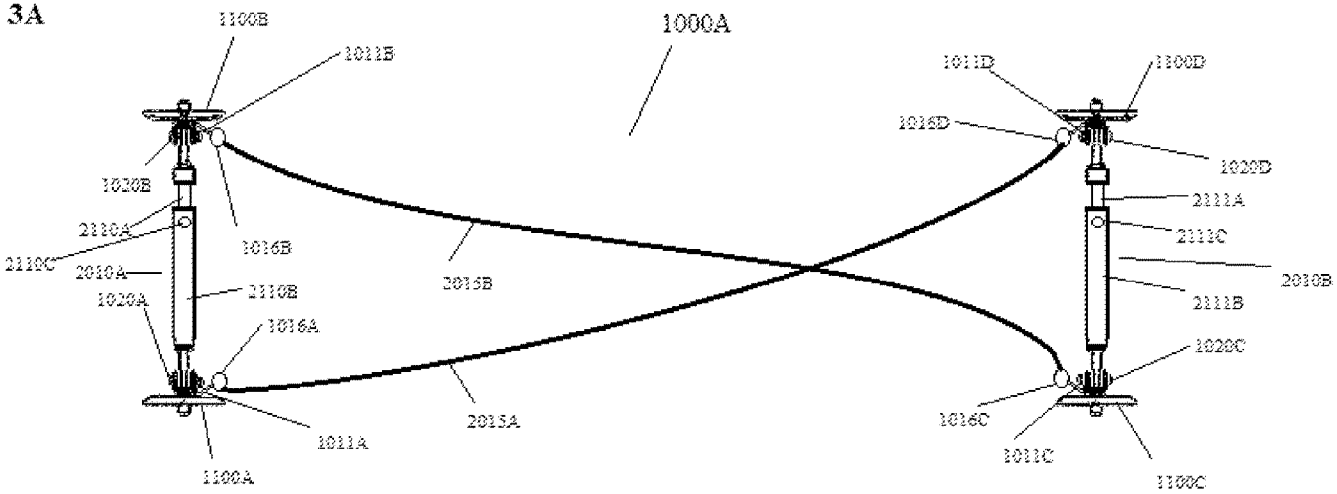
FIG. 3A provides a view of a mooring system, according to an embodiment of the present invention.
Figure 3B:
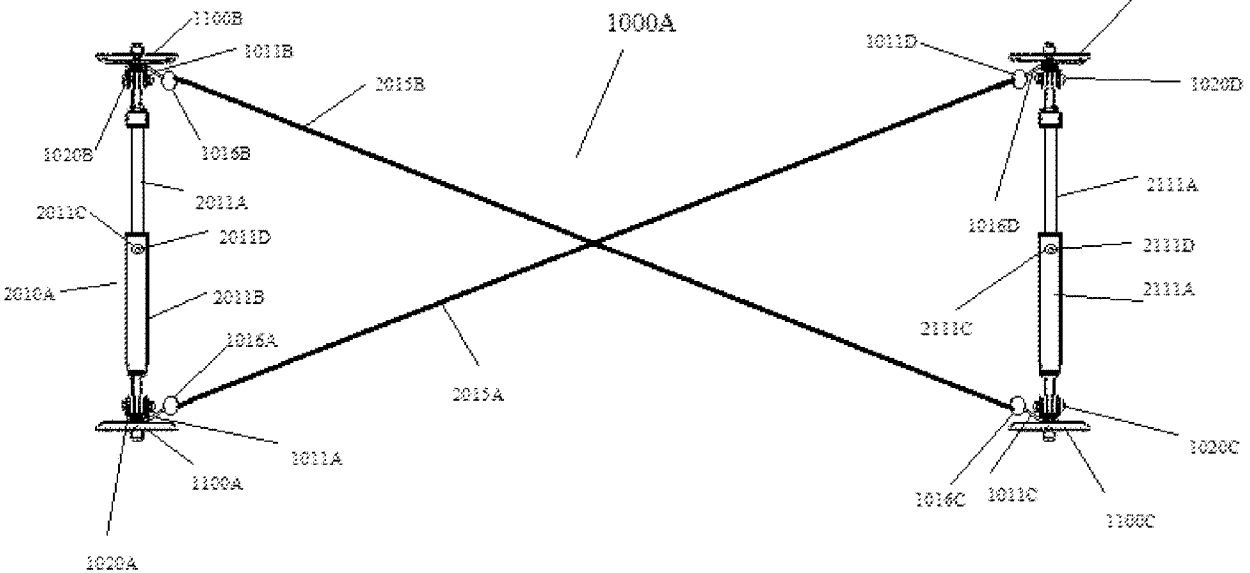
FIG. 3B provides a view of a mooring system, according to an embodiment of the present invention.

FIGS. 3A-3B show another embodiment of the mooring system, mooring system 1000*a*, having the spacing members 2010A and 2010B at a predetermined distance from one another in a substantially parallel arrangement. The spacer members 2010A and 2010B may be extendable from a short, retracted position, as shown in FIG. 3A, to a longer, extended position as shown in FIG. 3B. The spacer members 2010A and 2010B be fixed in the extended position to establish the spacing between the connected vessels (or a vessel and a static structure, like a dock). In such embodiments, the mooring system 1000*a* may include tethering members 2015A and 2015B (e.g., cords, cables, ropes, or other appropriate structures) configured in criss-cross pattern between the spacing members 2010A and 2010B to create a stable parallel arrangement of the spacing members 2010A and 2010B. The distance between anchoring structures 1100A and 1100C, and the distance between anchoring structures 1100B and 1100D are equal and predetermined to allow for both (1) the extension of the spacing members 2010A and 2010B to the extended position, while (2) the tensioning of fixed length tethering members 2015A and 2015B such that the system is stable.

In such embodiments, the tethering members 2015A and 2015B have a fixed length and are tensioned by the extension of the spacer members 2010A and 2010B to the extended position, thereby increasing the distance between the attachment points of the tethering members 2015A and 2015B. The first tethering member 2015A and second tethering member 2015B are tight when the spacing members 2010A and 2010B in extended position and create stability in the system and the spacing members 2010A and 2010B are held in parallel configuration, stably holding the two vessels (or a vessel and a static structure, like a dock) at distance equal to the length of the extended spacing members 2010A and 2010B. The spacing members 2010A and 2010B may be held in the extended position by a locking mechanism, such as a spring-biased pin 2110D on telescoping section 2011A that engages with complementary receiving hole 2110C on telescoping section 2011B. Likewise, a spring-biased pin 2111D on telescoping section 2111A that engages with complementary receiving hole 2111C on telescoping section 2111B. The length of the extended spacing members 2010A and 2010B may be in a range of about 18 inches to about 36 inches (e.g., about 20 inches to about 30 inches, about 24 inches, or any value therein). The length of the spacing members 2010A and 2010B in the retracted position may be in a range of about 10 inches to about 20 inches (e.g., about 12 inches to about 18 inches, about 15 inches, or any value therein).

The tensioning members 2015A and 2015B (e.g., straps or cords) are connected at each end to one of the spacing members 2010A and 2010B in a criss-cross pattern to stabilize the system 1000*a*. Each anchoring structure 1100A, 1100B, 1100C, and 1100D includes an attachment point for connecting to one end of one of the tensioning members 2015A and 2015B. For example, each anchoring structure may include a ring or rigid loop structure to which the tensioning member can be connected. Anchoring structure 1100A includes an attachment point 1011A, anchoring structure 1100B includes an attachment point 1011B, anchoring structure 1100C includes an attachment point 1011C, and anchoring structure 1100D includes an attachment point 10111D. Each tensioning member 2015A, 2015B may include a connector at each end thereof for attaching to one of the attachment points 1011A, 1011B, 1011C, and 1011D. Tensioning member 2015A includes connectors 1016A and 1016D, and tensioning member 2015B includes connectors 1016B and 1016C. The connector may be a clip such as a carabiner clip, mountaineer's clip, D-clip a round-eye swivel snap, or other appropriate attachment mechanism fixedly connected to a distal end of one of the tensioning members 2015A and 2015B. The tensioning members may be a strap, cord or wire (e.g., a woven strap, cord or wire) that comprises a high tensile strength material, such as nylon, steel (e.g., high strength alloy ASTM A514), high-density polyethylene (HDPE), polypropylene, polyester resin, polyamide thermoplastic, and other appropriate materials.

The anchoring structures 1100A, 1100B, 1100C, and 1100D may be connected to the rotational joints 1020A, 1020B, 1020C, and 1020D of the spacing members 2010A and 2010B by a reversibly locking mechanism that provides for efficient attachment and detachment of the system spacing members 2010A and 2010B from the anchoring structures 1100A, 1100B, 1100C, and 1100D and thus the vessels A and B. It shall be understood that the anchoring structures operable to be connected to a stationary structure, such as a dock, allowing the mooring system 1000A to connect a watercraft to such stationary structure. The distance between anchoring structures 1100A and 1100C, and the distance between anchoring structures 1100B and 1100D when installed on a vessel or static structure (e.g., a dock) are equal and predetermined to allow for both (1) the extension of the spacing members 2010A and 2010B to the extended position, while (2) the tensioning of fixed length tethering members 2015A and 2015B such that the system is stable. For example, the anchoring structures 1100A and 1100C may be spaced apart along the hull of a first vessel at a distance of 14 feet, the anchoring structures 1100B and 1100D may be spaced apart along the hull of a second vessel at a distance of 14 feet, the extended lengths of the spacing members 2010A and 2010B may both be 24 inches, and the lengths of the tethering members 2015A and 2015B may both be 169 inches. Note that the material of the tethering members 2015A and 2015B may be somewhat elastic to allow axial deformation (stretching) in a range of up to about 1% of the length of the tethering members 2015A and 2015B.

Figure 4:
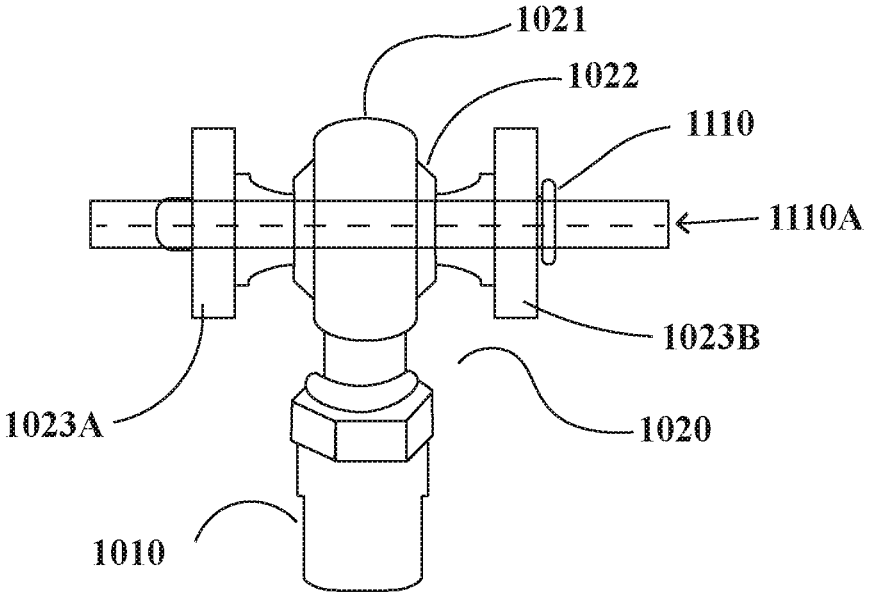
FIG. 4 provides a view of a rotational joint and other components of a novel mooring system, according to an embodiment of the present invention.
Figure 5:
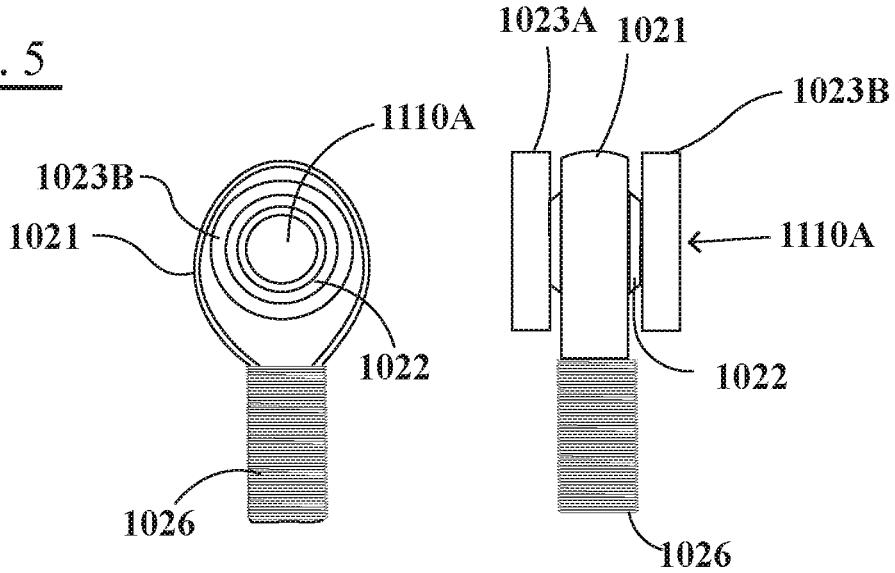
FIG. 5 provides a view of a rotational joint and other components of a novel mooring system, according to an embodiment of the present invention.

FIGS. 4-5 close-up views of the rotational joint 1020 located at each distal end of the spacing members 1010A and 1010B. FIG. 4 provides an exploded view of the rotational joint 1020 with pin 1110 passed through a pin path 1110A. The rotational joint may include an outer ring 1021 having a 3600 concave inner track in which an inner ball 1022 is nested. The convex outer surface of the inner ball 1022 interfaces with the inner concave track of the outer ring 1021, such that the inner ball 1022 can freely rotate and spin within the outer ring 1021. The inner ball 1022 may include spacers 1023A and 1023B that are inserted into or attached to the inner ball 1022 in order to provide structures that are positioned in close proximity to the bracket to prevent sliding of the rotational joint within the bracket of the anchoring structures 1100A, 1100B, 1100C, and 1100D, and to limit the rotation of the inner ball 1022 in the outer ring 1021. The spacers 1023A and 1023B are shown in FIG. 4 in an exploded position for illustrative purposes, and are shown in a fully inserted and functional position in FIG. 5. FIG. 4 also presents the outer ring 1021, inner ring 1022, and spacers 1023A and 1023B in a transparent manner in order to illustrate the pin path 1110A and placement of pin 1110 through the spacers 1023A and 1023B and inner ring 1022. The inner ball 1022 may have an axial hole 1025 running therethrough that allows for passage 1110A of a locking pin 1110. FIG. 5 provides side and profile views of the rotational joint 1020 in an assembled, functional condition. The rotational joint 1020 is shown detached from the spacing member, with a stem 1026 for attaching to a spacing member shown. The pin path 1110A is shown in axial and profile views without the pin 1110 inserted therethrough.

Figure 6:
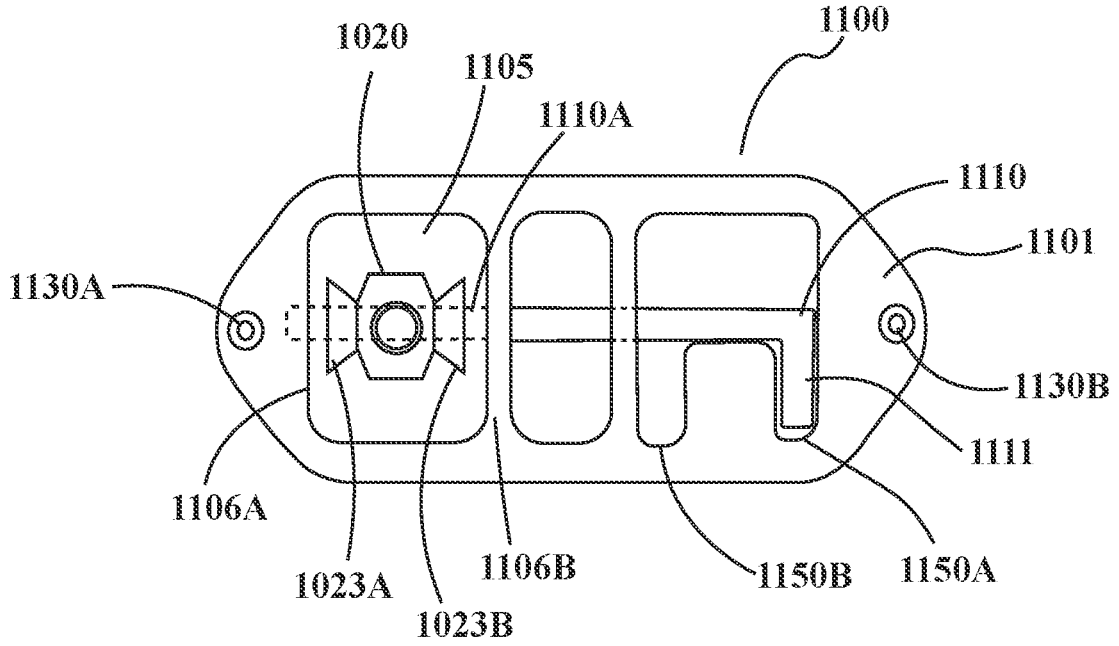
FIG. 6 provides a view of an anchoring structure and other components of a novel mooring system, according to an embodiment of the present invention.
Figure 7:
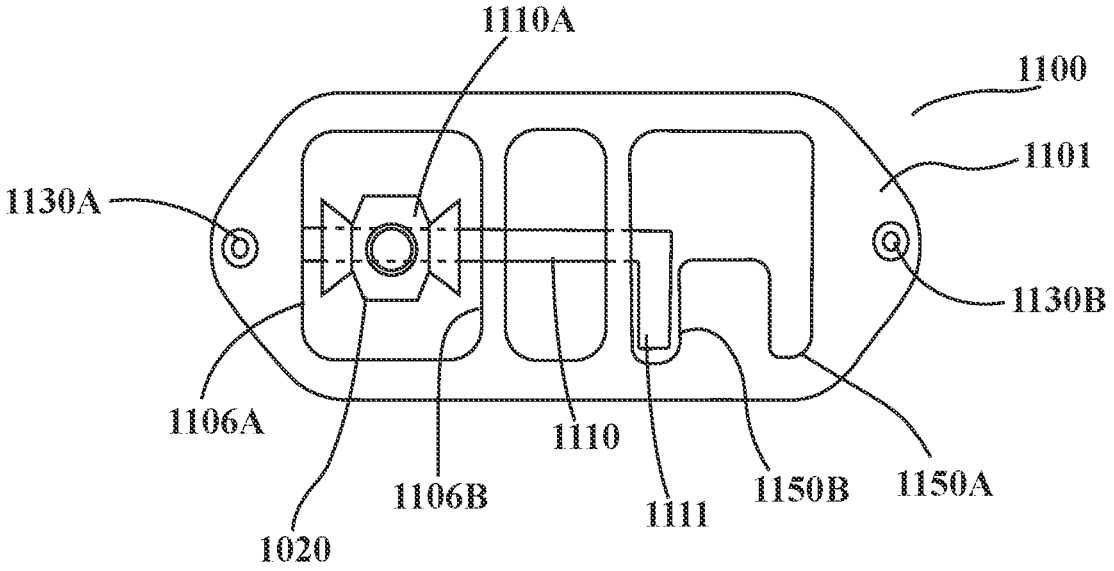
FIG. 7 provides a view of an anchoring structure and other components of a novel mooring system, according to an embodiment of the present invention.

FIGS. 6-7 provide views of an embodiment of the anchoring structure 1100, which is an embodiment of the anchoring structures 1100A, 1100B, 1100C, and 1100D of FIGS. 1-3. The anchoring structure 1100 may be installed in the hull, gunwale, or other structure on a boat and fixed in place by fasteners (e.g., screws, bolts, etc.) passed through fastener receivers 1130A and 1130B. The anchoring structure 1100 may have a receiver 1105 for receiving the rotational joint 1020. The receiver 1105 may be a recess sized to accommodate the rotational joint 1020, having side walls 1106A and 1106B that may provide enough space to allow the rotational joint to be inserted with a small amount of space on the outer side of each of the spacers 1023A and 1023B. This arrangement allows the spacers 1023A and 1023B to be in close proximity to the side walls 1106A and 1106B and prevent sliding of the rotational joint 1020 within the receiver 1105.

The rotational joint 1020 may be inserted into the receiver 1105 such that the pin passage 1110A is aligned with pinhole 11101B in side walls 1106A and 1106B. The pin 1110 may then be advanced from a retracted position, as shown in FIG. 6, to a locked position as shown in FIG. 7. The anchoring structure 1100 may include two locking slots 1150A and 1150B to hold the pin 1110 in place. The locking slot 1150A may receive a lever 1111 of the pin 1110 by rotation of the pin 1110 (e.g., by about 45°) around the central axis of the pin 1110, thereby positioning the lever 1111 in the locking slot 1150A. The positioning of the lever 1111 in the locking slot 1150A arrests the pin 1110 in the retracted position, as shown in FIG. 6. Similarly, the locking slot 1150B may receive a lever 1111 of the pin 1110 by rotation of the pin 1110 (e.g., by about 45°) around the central axis of the pin 1110 when the pin 1110 is advanced through the pin path 1110A and into the locked position, thereby positioning the lever 1111 in the locking slot 1150B. The positioning of the lever 1111 in the locking slot 1150B arrests the pin 1110 in the locked position, as shown in FIG. 7. The positioning of the pin 1110 through the pin path 1110 through the rotational joint 1020 fixes the spacing member to which the rotational joint 1110 is attached to the anchoring structure 1100, while allowing for limited shifting of the spacing member. The rotational joint 1020 may allow for rotation shifting of the spacing member relative to the anchoring structure 1100 in a range of no more than about 5° to about 30° (e.g., about 10° to about 20°, or any range of values therein) relative to a perpendicular from the outer surface 1101 of the anchoring structure 1100.

Figure 8:
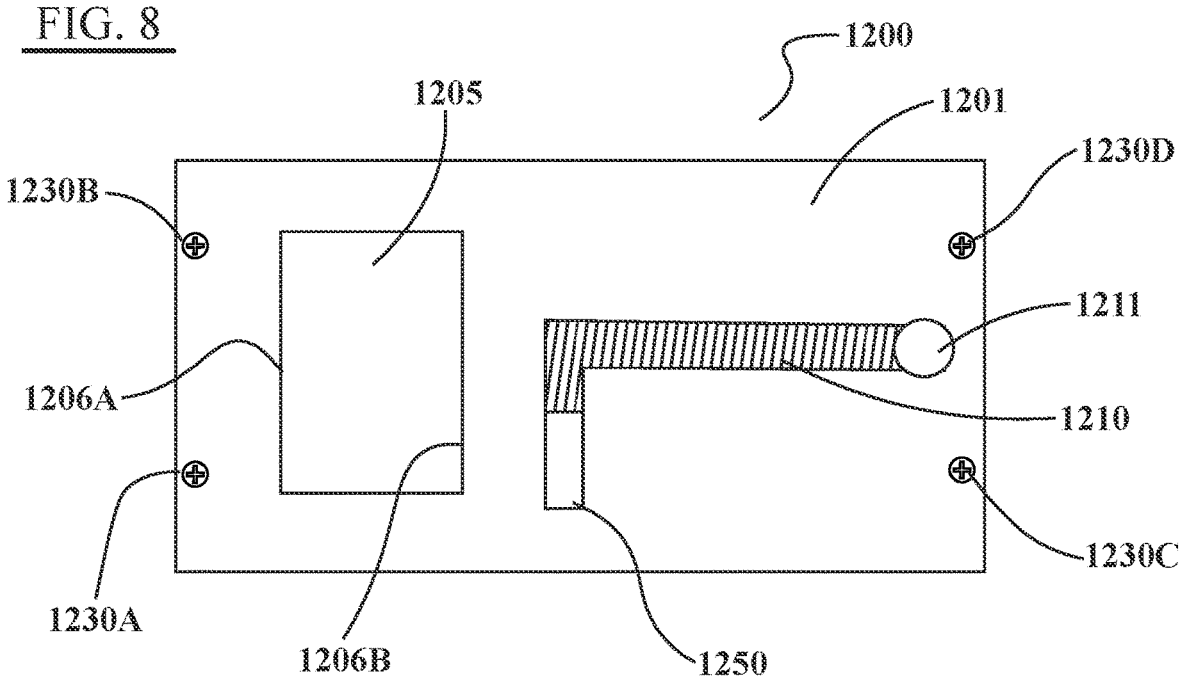
FIG. 8 provides a view of an anchoring structure and other components of a novel mooring system, according to an embodiment of the present invention.
Figure 9:
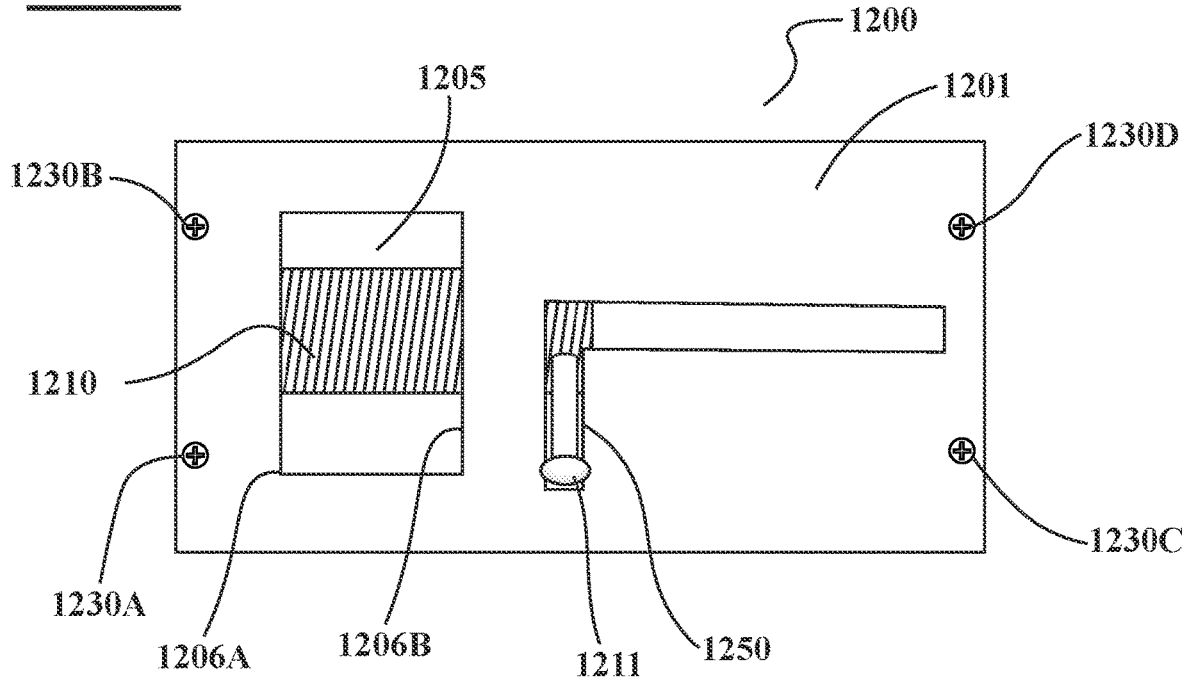
FIG. 9 provides a view of an anchoring structure and other components of a novel mooring system, according to an embodiment of the present invention.

FIGS. 8-9 show a similar embodiment to the embodiment shown in FIGS. 6-7. The anchoring structure 1200 may have a receiver 1205 for receiving the rotational joint 1020. The receiver 1205 may be a recess sized to accommodate the rotational joint 1020, having side walls 1206A and 1206B that may provide enough space to allow the rotational joint to be inserted with a small amount of space on the outer side of each of the spacers 1023A and 1023B. This arrangement allows the spacers 1023A and 1023B to be in close proximity to the side walls 1206A and 1206B and prevent sliding of the rotational joint 1020 within the receiver 1205. The receiver 1205 may be installed in the hull, gunwale, or other structure on a boat and fixed in place by fasteners (e.g., screws, bolts, etc.) passed through fastener receivers 1230A, 1230B, 1230C, and 1230D.

Figure 10:
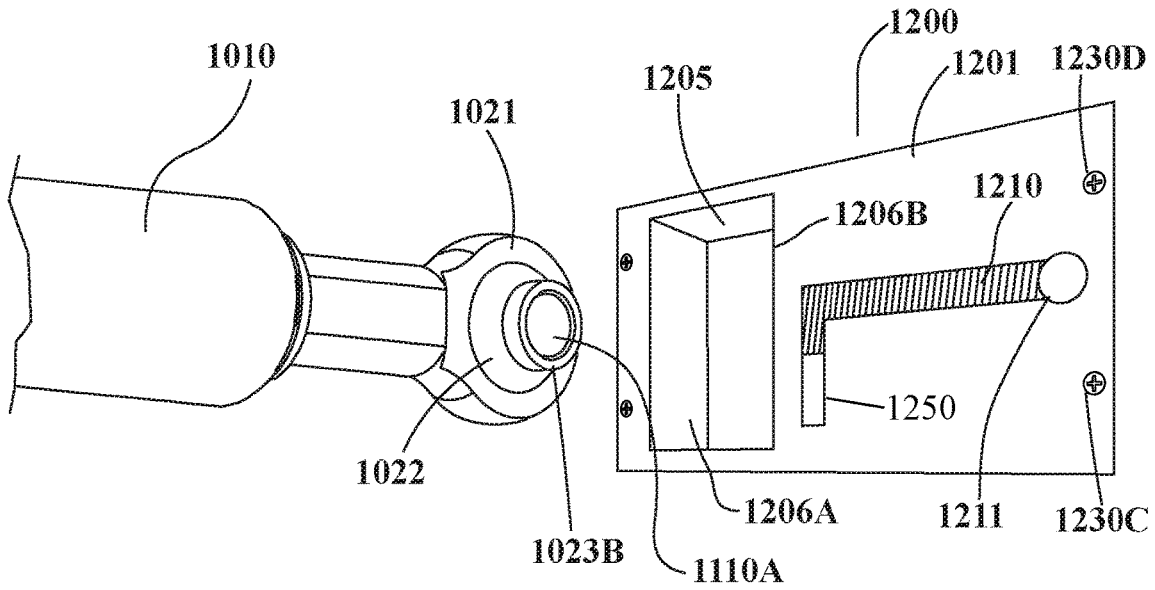
FIG. 10 provides a perspective view of an anchoring structure and other components of a novel mooring system, according to an embodiment of the present invention.
Figure 11:
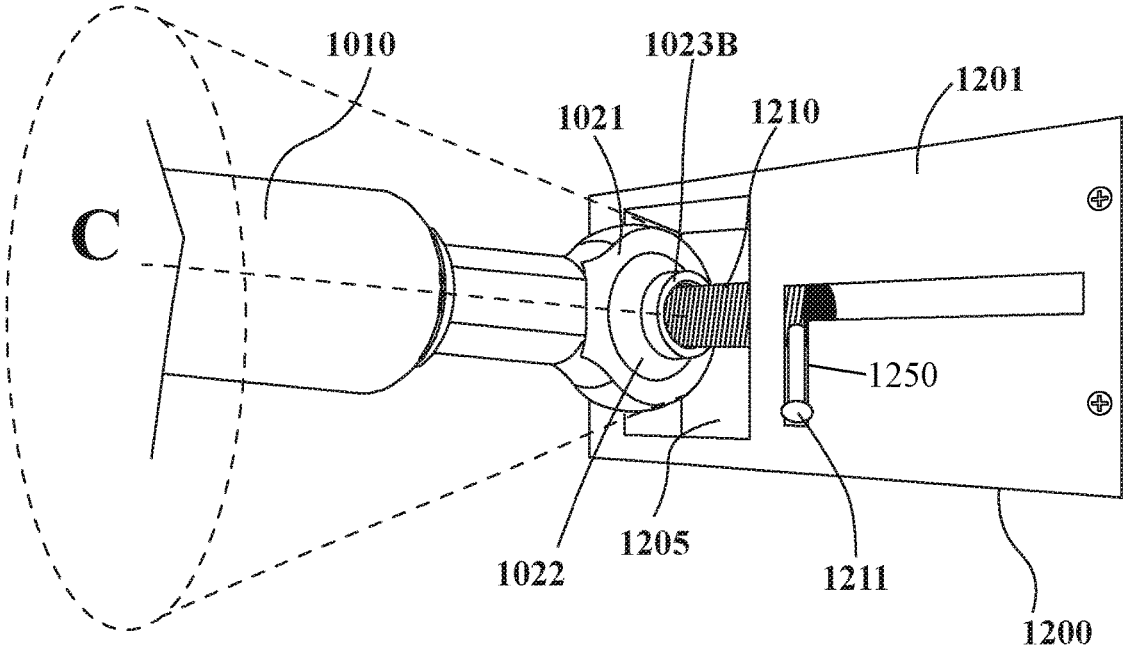
FIG. 11 provides a perspective view of an anchoring structure and other components of a novel mooring system, according to an embodiment of the present invention.

As shown in FIGS. 10-11, the rotational joint 1020 may be inserted into the receiver 1205 such that the pin passage 1110A is aligned with a pin. The pin 1110 may then be advanced from a retracted position, as shown in FIG. 10, to a locked position as shown in FIG. 10. The anchoring structure 1200 may include a locking slot 1250 to hold the pin 1210 in place. The locking slot 1250 may receive a lever 1211 of the pin 1210 by rotation of the pin 1210 (e.g., by at least about 45°) around the central axis of the pin 1210, thereby positioning the lever 1211 in the locking slot 1250. The positioning of the lever 1211 in the locking slot 1250 arrests the pin 1210 in the locked position, as shown in FIG. 11. The positioning of the pin 1210 through the pin path 1110A through the rotational joint 1020 fixes the spacing member 1010 to which the rotational joint 1020 is attached to the anchoring structure 1200, while allowing for limited shifting of the spacing member 1010. The rotational joint 1020 may allow for rotation shifting of the spacing member relative to the anchoring structure 1200 in a range of no more than about 5° to about 20° relative to a perpendicular C from the outer surface 1201 of the anchoring structure 1200. The rotational joint 1020 may allow for a movement and pivoting of the spacer bar 1010 relative to the rotational joint 1020 in any direction within a conical zone around a perpendicular C to the outer surface of an anchoring structure 1200, as shown in FIG. 11.

Figure 12:
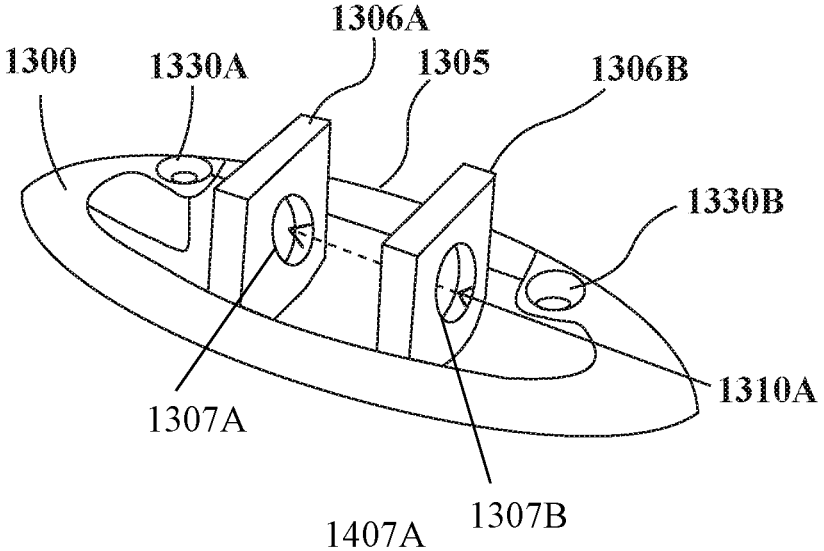
FIG. 12 provides a perspective view of an anchoring structure of a novel mooring system, according to an embodiment of the present invention.

FIG. 12 provides an additional embodiment of the anchoring structure. Anchoring structure 1300 has a construction that resembles a cleat that can be installed on the hull or gunwale of a watercraft by fasteners passed through fastener receivers 1330A and 1330B. The anchoring structure 1300 includes a bracket structure that includes bracket members 1306A and 1306B, each having pin holes (1307A and 1307B, respectively) through which a pin can be passed. The bracket creates a receiving structure 1305 for receiving the rotational joint 1020 of the spacer 1010. The pin passage 1110A of the rotational joint 1020 may be aligned with the pinholes 1307A and 1307B, and the pin may then be passed through pin passage 1110A, pinhole 1307A, and pin hole 1307B to reversibly fix the rotational joint 1020 to the anchoring structure 1300.

Figure 13:
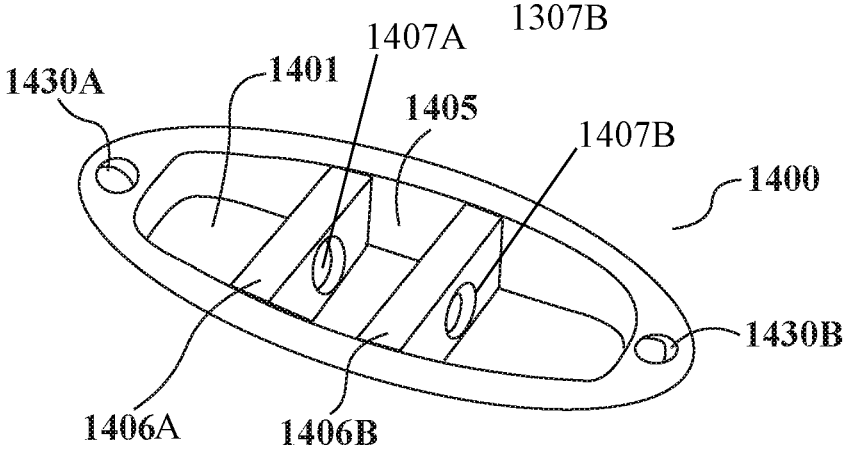
FIG. 13 provides a perspective view of an anchoring structure of a novel mooring system, according to an embodiment of the present invention.
Figure 14:
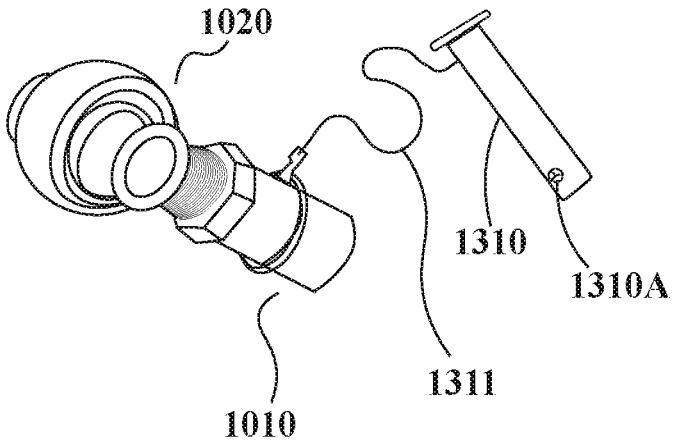
FIG. 14 provides a perspective view of a rotational joint and other components of a novel mooring system, according to an embodiment of the present invention.

FIG. 13 provides an additional embodiment, anchoring structure 1400, which also has a construction that resembles a cleat that can be installed on the hull or gunwale of a watercraft by fasteners passed through fastener receivers 1430A and 1430B. The anchoring structure 1400 includes a recessed bracket structure that is positioned within recess 1401. The bracket structure includes bracket member 1406A having pin hole 1407A and bracket member 1406B having pin hole 1407B, through which a pin can be passed. The bracket creates a receiving structure 1405 for receiving the rotational joint 1020 of the spacer 1010. The pin passage 1110A of the rotational joint 1020 may be aligned with the pinholes 1407A and 1407B, and the pin may then be passed through pin passage 1110A, pinhole 1407A, and pin hole 1407B to reversibly fix the rotational joint 1020 to the anchoring structure 1400. FIG. 14 shows the spacer 1010 and rotational joint 1020 with a pin 1310 attached to the spacer 1010 by retaining line 1311. This particular arrangement of the pin 1310 and the spacer 1010 may be utilized in combination with the anchoring structures 1300 and 1400 shown in FIGS. 12 and 13. Because the anchoring structures 1300 and 1400 do not include an integral pin, the pin 1310 may be advantageously attached to the spacer 1010 so that it is not lost. The pin 1310 may have a biased locking device 1310A thereon that prevents dislodgement of the pin 1310 from the receiver 1305 or 1405 when the rotational joint 1020 is installed therein. The biased locking device 1310A may be a spring-biased ball bearing, pin or other appropriate structure.

Figure 15:
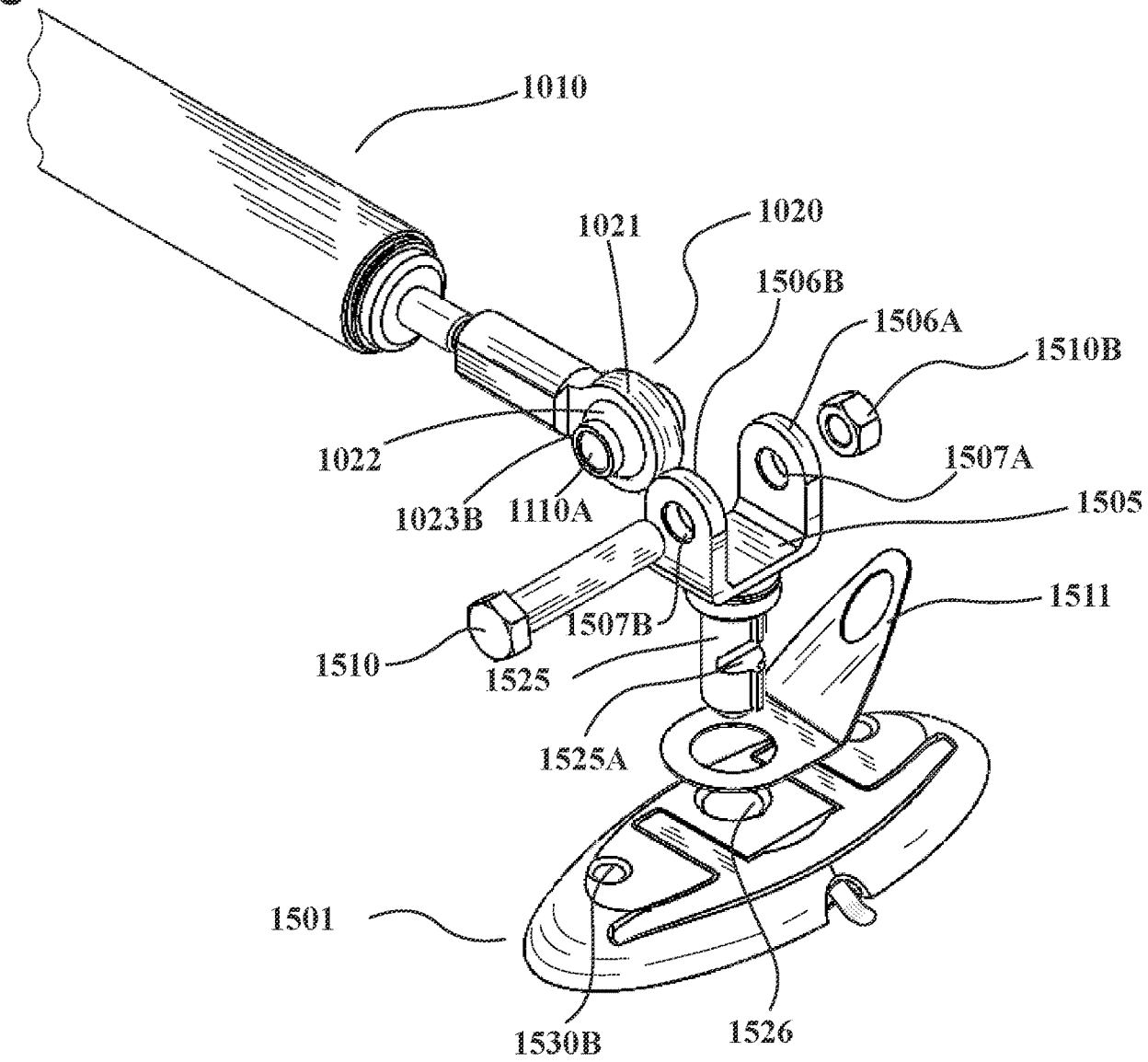
FIG. 15 provides a perspective exploded view of a novel mooring system, according to an embodiment of the present invention.
Figure 16:
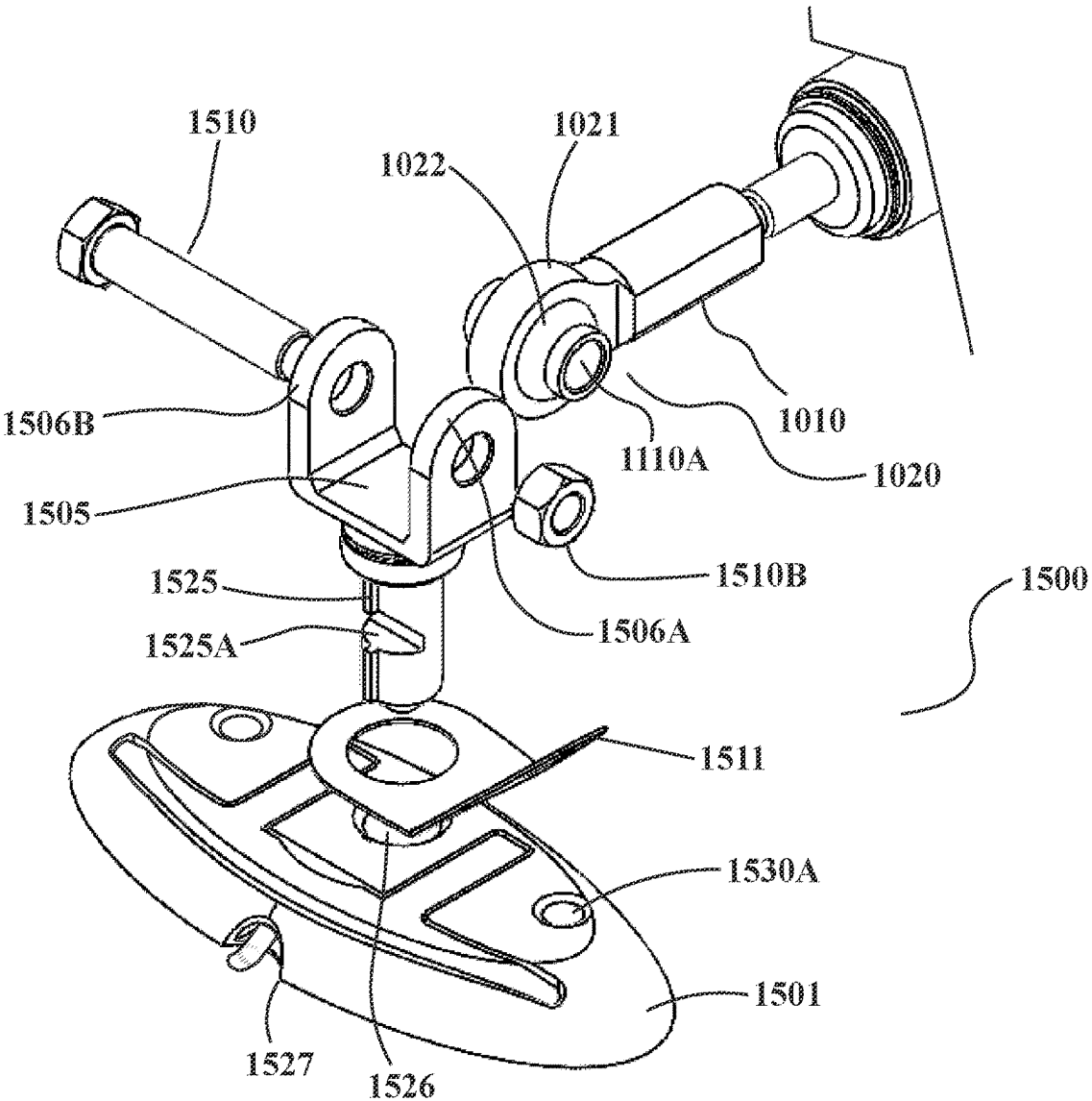
FIG. 16 provides a perspective exploded view of a novel mooring system, according to an embodiment of the present invention.

FIGS. 15-16 show a further embodiment of anchoring structure 1500. FIG. 15 provides a close-up, exploded view of the connection mechanism of anchoring structure 1500 and spacer 1010 according to an embodiment of the present invention. The anchoring structure 1500 includes a cleat and may be fixed to a vessel or a dock or other stationary structure by fastening receivers 1530A and 1530B, and a novel connection system for receiving a rotational joint 1020 of the spacer 1010. The anchoring structure 1500 may include a bracket receiver 1505 having bracket plates 1506A and 1506B, each having a pinhole (1507A and 1507B, respectively) for receiving a locking pin 1510. The rotational joint 1020 may be inserted into the bracket receiver 1505 such that the pin passage 1110A is aligned with the pinholes 1507A and 1507B, and the locking pin 1510 may be inserted through the pin passage 1110A and the pinholes 1507A and 1507B and reversibly lock the rotational joint 1020 in place within the bracket receiver 1505. The locking pin 1510 may be locked into place by a nut or other securing structure 1510B positioned on the distal end of the locking pin 1510. The anchoring device 1500 may include a quick release mechanism that connects the bracket receiver 1505 to the cleat base 1501. The quick release mechanism allows for fast attachment and release of the bracket receiver 1505 from the cleat base 1501.

The quick release mechanism may include a connection stud 1525 that protrudes from the bracket receiver 1505. The connection stud 1525 includes a notch 1525A for engaging with a biased pin 1527. The connection stud 1525 may be inserted into connection receiver 1526 in the cleat base 1501. When the connection stud 1525 is fully inserted into the connection receiver 1526, the biased pin 1527 engages with (e.g., inserts into) the notch 1525A, and thereby reversibly fixes the connection stud 1525 in the connection receiver 1526, as the presence of the biased pin 1527 in the notch 1525A. The connection stud 1525 may be released from the connection receiver 1526 by pulling the biased pin 1527 outward to remove it from the notch 1525A.

Figure 17:
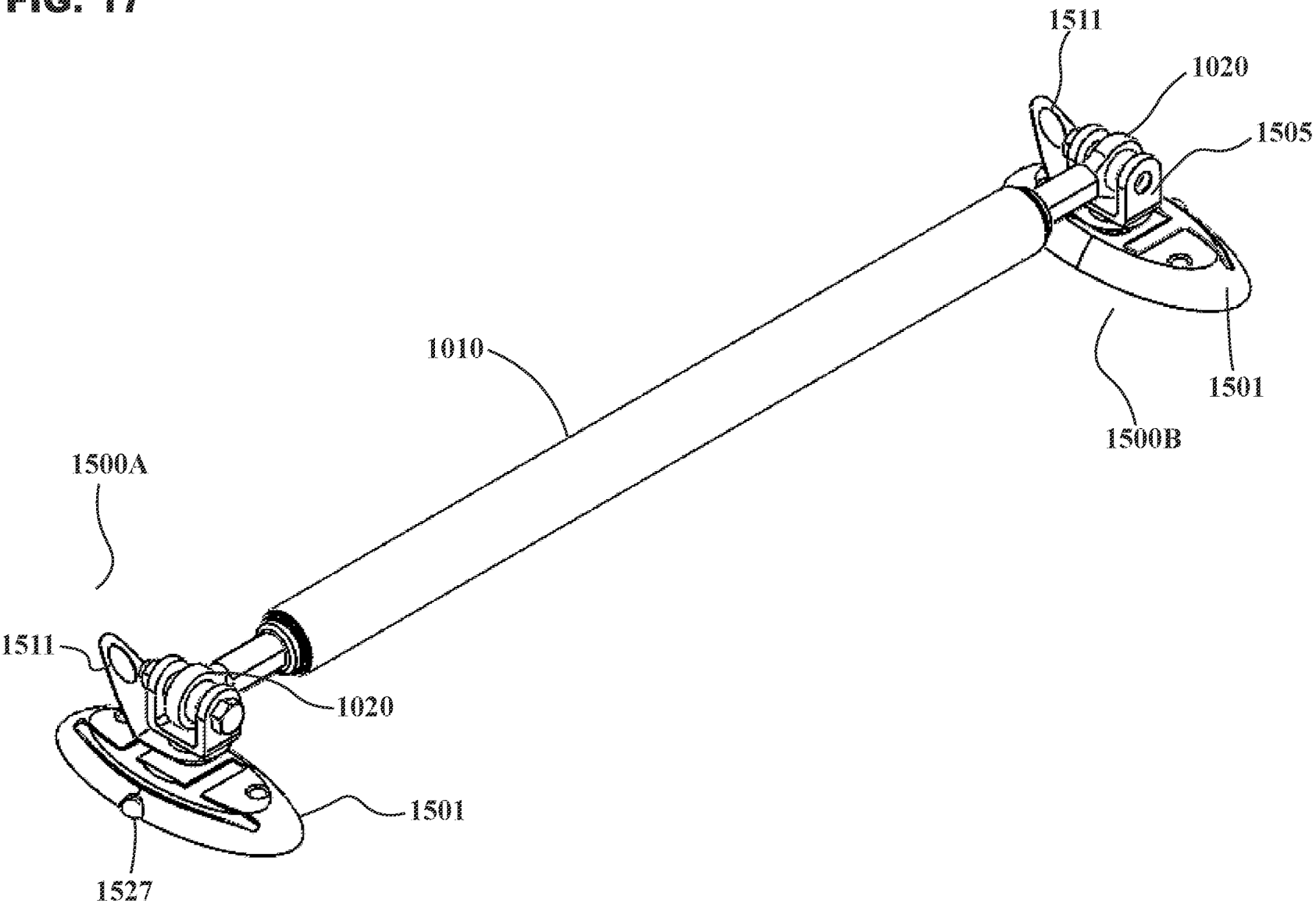
FIG. 17 provides a perspective view of a novel mooring system, according to an embodiment of the present invention.
Figure 18:
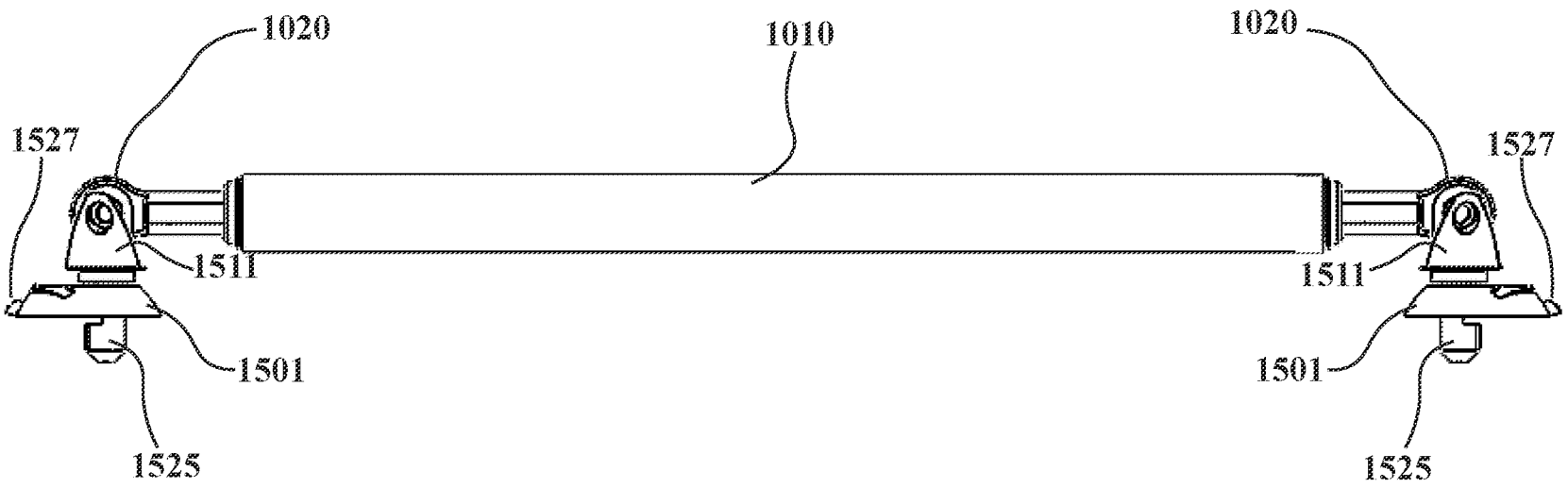
FIG. 18 provides an side view of a novel mooring system, according to an embodiment of the present invention.
Figure 19:
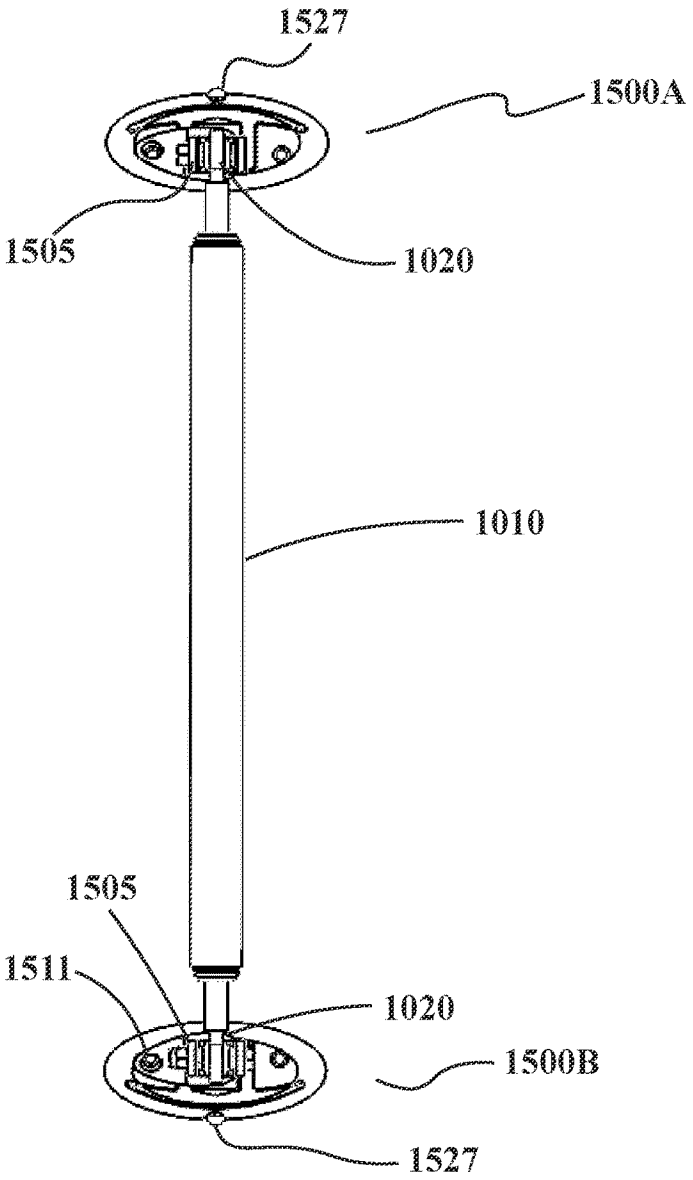
FIG. 19 provides an overhead view of a novel mooring system, according to an embodiment of the present invention.

FIGS. 17-18 provides multiple views of the connection of a single spacer 1010 between two of the anchoring structures 1500A and 1500B, demonstrating the arrangement of the novel rotational joint 1020 to the anchoring structures 1500A and 1500B with the locking pin 1510 positioned in the bracket receiver of the anchoring structures 1500A and 1500B. The connections between the spacer 1010 and the other anchoring structure embodiments (e.g., those shown in FIGS. 1-13) would be arranged in a similar manner.

Figure 20:
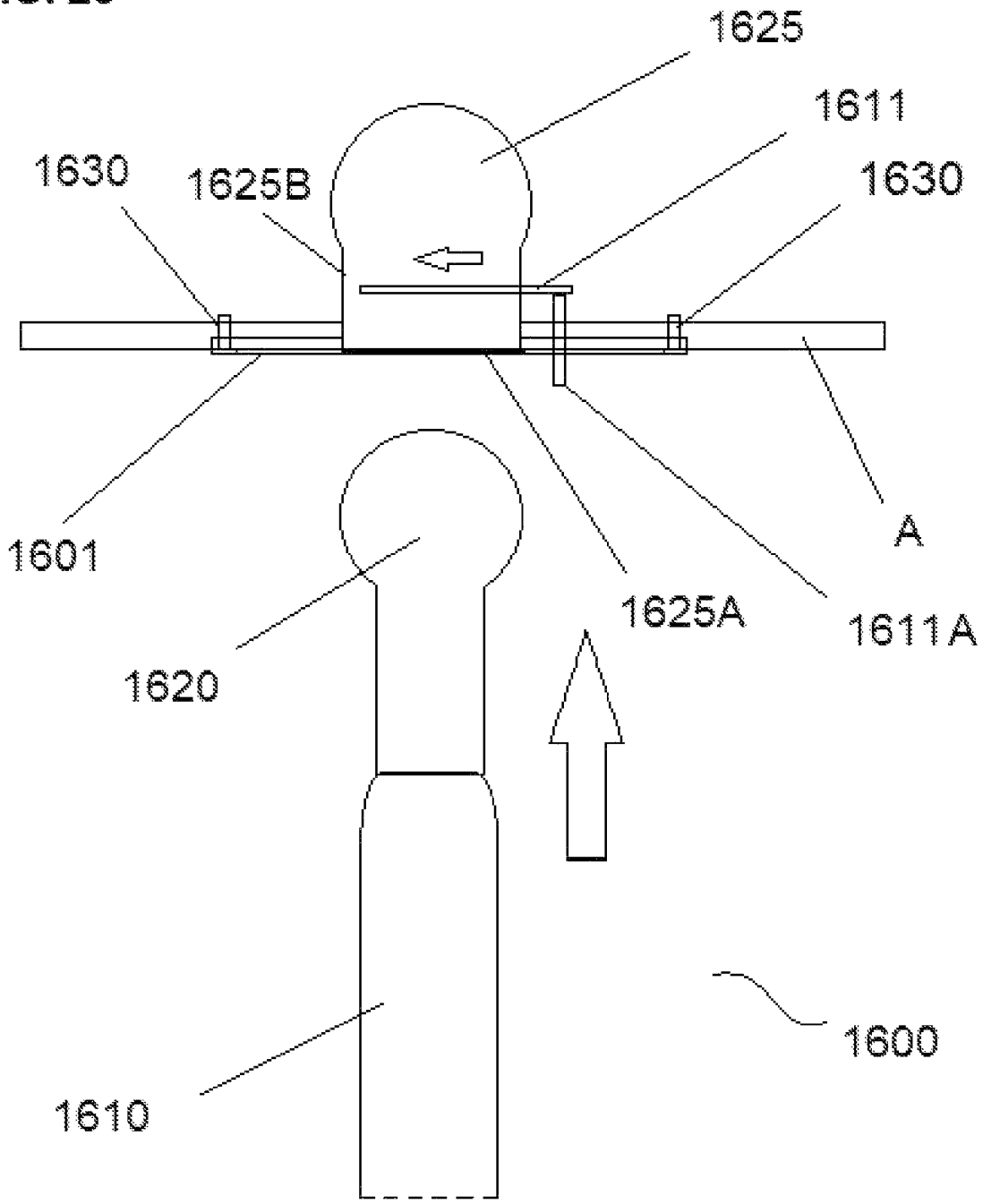
FIG. 20 provides an overhead cross-sectional view of a novel mooring system, according to an embodiment of the present invention.
Figure 21:
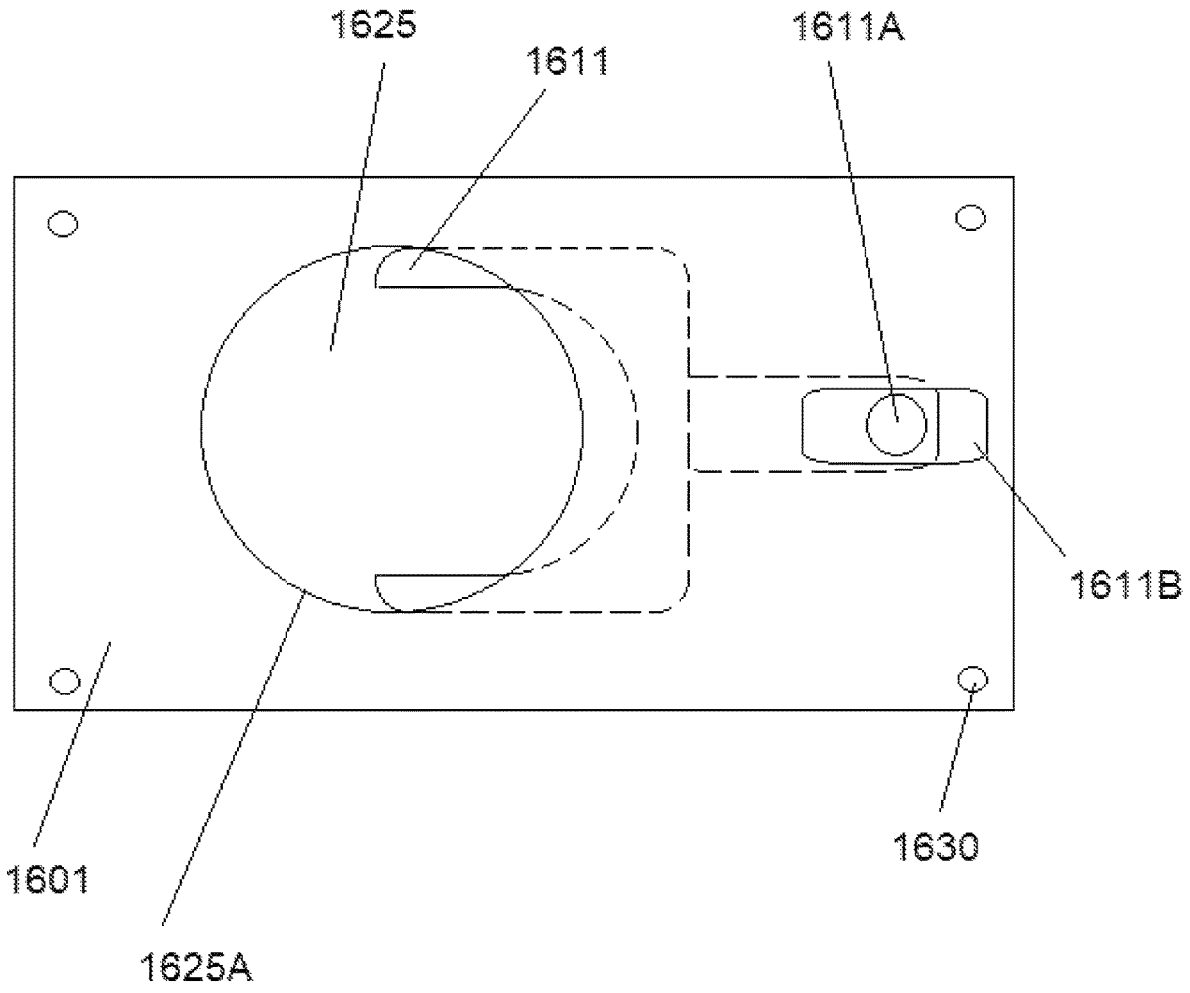
FIG. 21 provides a frontal view of a novel mooring system, according to an embodiment of the present invention.
Figure 22:
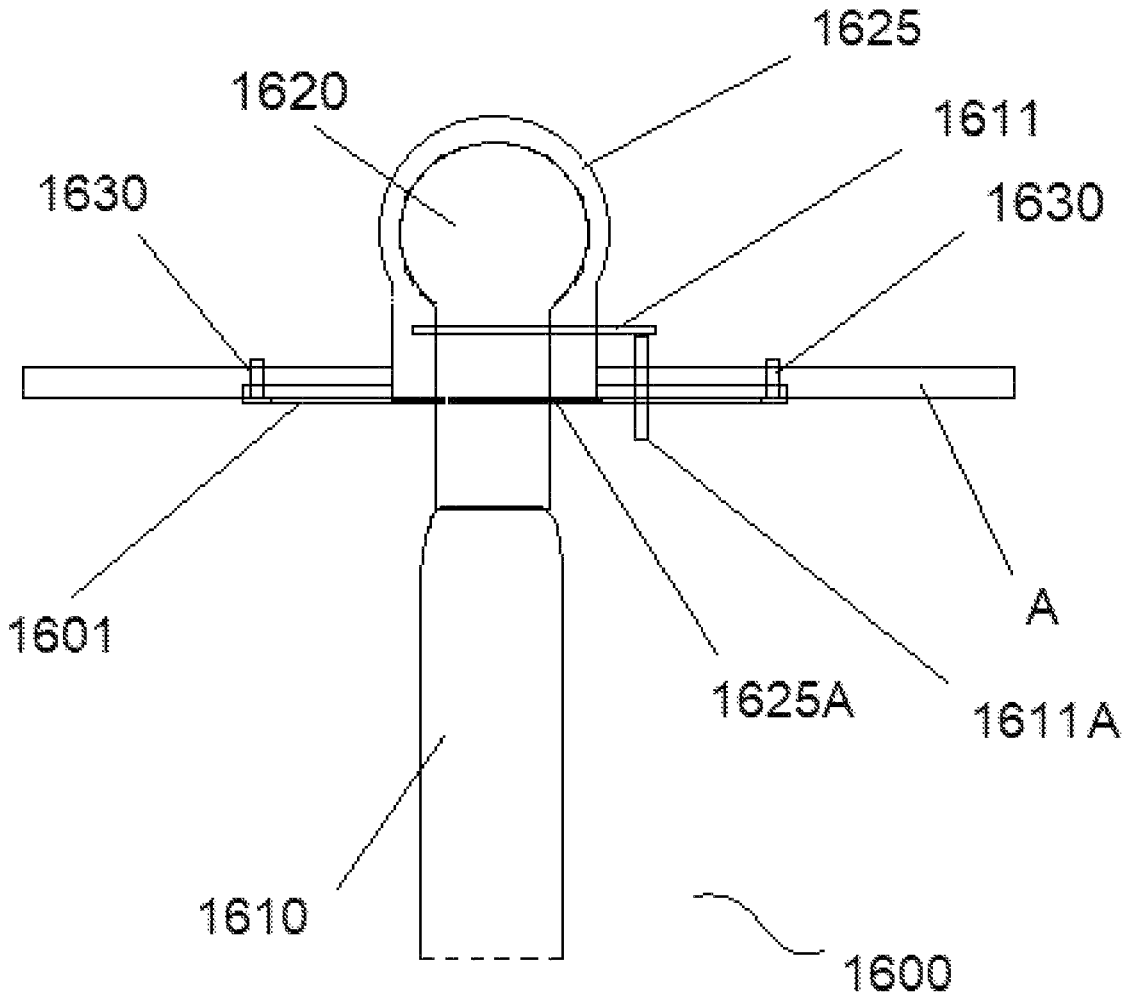
FIG. 22 provides an overhead cross-sectional view of a novel mooring system, according to an embodiment of the present invention.

FIGS. 20-22 show a further embodiment of an anchoring structure 1600. FIG. 20 provides a cross-sectional view of a ball and socket-style connection mechanism of anchoring structure 1601 and spacer 1610 according to an embodiment of the present invention. The anchoring structure 1601 has a socket-style receiver 1625 for receiving the ball 1620 on a spacer 1610. The receiver 1625 may be a recess sized to accommodate the ball 1620, having a size and shape that is complementary to the ball 1620 and opening 1625 may have an inner diameter sufficiently large to allow the ball 1620 to pass into the socket receiver 1625. The opening 1625A and throat 1625B of the socket receiver 1625 may have sufficiently sized inner diameters to allow the ball 1620 and shaft of the spacer 1610 to have some limited rotation to allow the boat to oscillate on the water without creating shearing or torsion forces between the anchoring structure 1601 and the hull A of the boat. The ball and socket arrangement allows the spacer 1610 to pivot through limited angles in the socket 1625 (e.g., in a range of no more than about 5° to about 20° relative to a perpendicular from the outer surface of the anchoring structure 1601) and without any dislocation of the ball 1620 within the socket receiver 1625. The receiver 1625 may be installed in hull A or other structure on a boat and fixed in place by fasteners 1630 (e.g., screws, bolts, etc.).

As shown in FIG. 21, the socket 1625 has a sliding latch mechanism that engages with the neck 1621 of the spacer 1610 thereby mechanically preventing the ball 1620 from dislocating from the socket 1625. The sliding latch may include a biased plate 1611 having a cutout that is complementary to the neck 1621 that is biased toward the socket 1625 as shown by the arrow in FIG. 20. The sliding latch may have a handle 1611A that passes through a slot 1611B and allows the user to slide the plate 1611 away from the socket 1625 to allow the ball 1620 to be inserted into the receiver 1625. Once the ball 1620 is inserted into the socket 1625, the latch handle 1611A may be released to allow the biased plate 1611 to slide back toward the socket 1625, engage the neck 1621 of spacer 1610, and thereby secure the ball 1620 in the socket 1625, as shown in the cross-sectional view of FIG. 22.

In some embodiments, the latching mechanism may have a locking mechanism that prevents any movement of the latching plate 1611 once the ball 1620 is in the socket 1625 and the latching plate 1611 is engaged with the neck 1621. The locking mechanism may be a pin that passes through the latch plate 1611 and the anchoring plate 1601. In other embodiments, the latching mechanism may have a pivoting hasp-style latch that passes over the pin 1611A and holds it in place. Other appropriate latches may be used as well.

Figure 23:
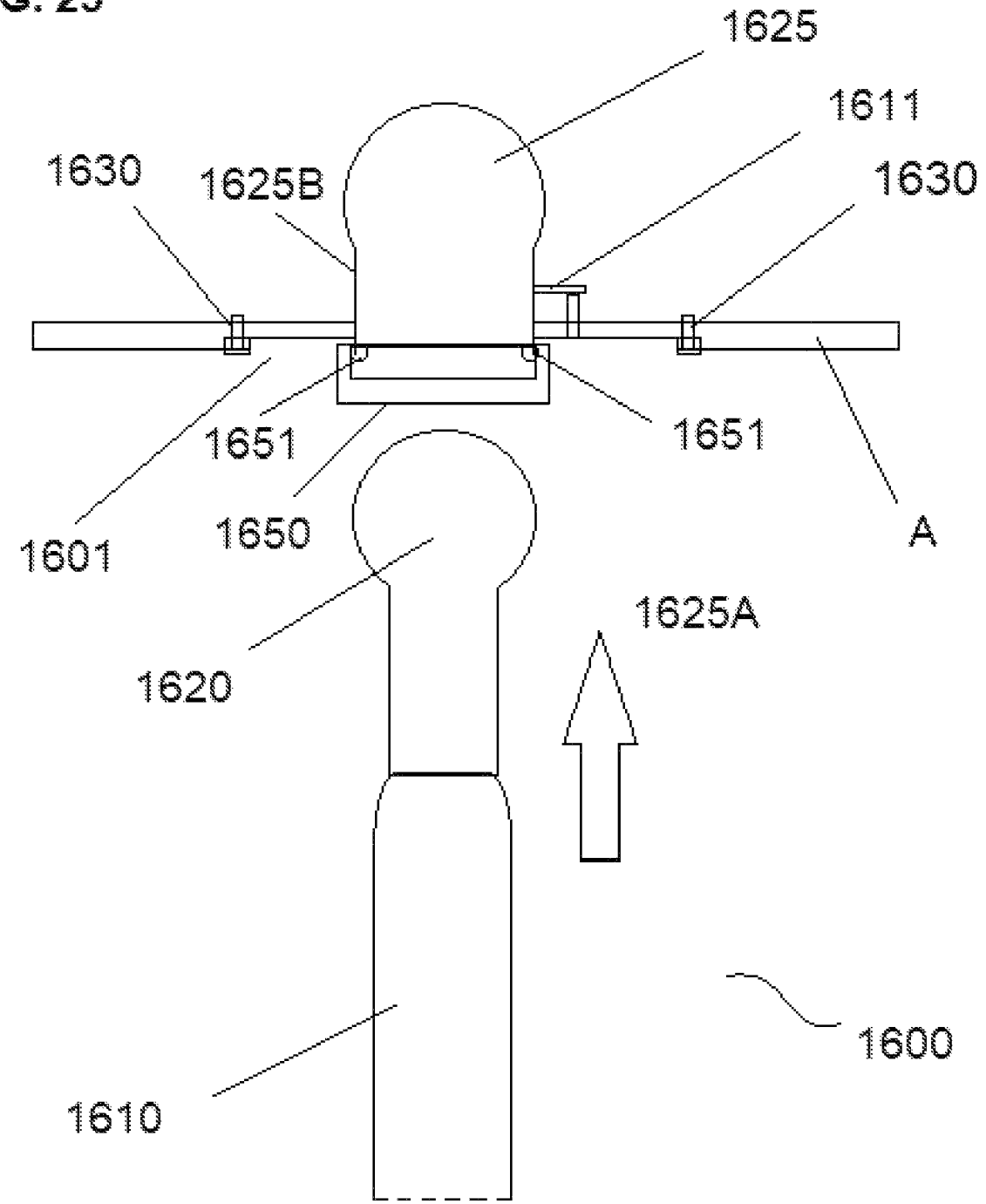
FIG. 23 provides an overhead cross-sectional view of a novel mooring system, according to an embodiment of the present invention.

In another embodiment shown in FIG. 23, the anchoring plate 1601 may include a quick release collar 1650 that is positioned exterior to the socket 1625, where the collar biases ball bearings 1651 into the throat 1625B that prevents the pullout of the ball 1620 when the collar 1650 is in the closed position. The collar 1650 may be biased toward the closed position. The user can position the collar into an open position (e.g., pull the collar outward) such that the collar 1650 is disengaged from the ball bearings 1651, allowing the ball 1620 to be inserted through the throat 1625B without obstruction by the ball bearings 1651. Once the ball is in the socket, the collar 1650 can be released such that it moves back into the closed position, thereby biasing the ball bearings 1651 into position in the throat 1625B and locking the ball 1620 into the socket 1625.

It should be understood that the foregoing descriptions of specific embodiments of the present invention have been presented for purposes of illustration and description. They are not intended to be exhaustive or to limit the invention to the precise forms disclosed, and many modifications and variations are possible in light of the above teachings. The embodiments were chosen and described in order to best explain the principles of the invention and its practical application, and to thereby enable others skilled in the art to best utilize the invention and various embodiments with various modifications as are suited to the particular use contemplated.

What is claimed:

1. A mooring apparatus comprising:

i. at least two spacing members having a rotating joint member at an end thereof and said at least two spacing members are extendable;

ii. at least a first tensioning member and a second tensioning member each having a fixed length, wherein said first and second tensioning members are operable to be connected to the two spacing members, wherein said first and second tensioning members are stretched in tension when attached to said at least two spacing members and said two spacing members are in an extended condition; and iii. an anchoring device having a receiver into which said rotating joint member is operable to be inserted, said anchoring device being operable to be attached to a hull of a boat or a dock.

2. The apparatus of claim 1, wherein the first and second spacing members are separated by a pre-determined distance.

3. The apparatus of claim 2, wherein said first tensioning member is operable to connect a first end of a first spacing member with a second end of a second spacing member for generating a first tension force therebetween and said second tensioning member is operable to connect a second end of the first spacing member with a first end of the second spacing member for generating a second tension force therebetween to cross-brace the first and second spacing members.

4. The apparatus of claim 3, wherein the first and second spacing members are elongate structures operable to be positioned in a parallel arrangement, and said first tensioning member and said second tensioning member are arranged in a criss-cross pattern with the first tensioning member connected at or near a first end of said first spacing member and a second end of said second spacing member, and the second tensioning member connected at or near a first end of said second spacing member and a second end of said first spacing member.

5. The apparatus of claim 3, wherein the first and second tension forces are increased by the extension of the first and second spacing members.

6. The apparatus of claim 1, wherein each of the at least two spacing members comprises at least two coaxial telescoping sections that slide past each to extend or retract the length of the spacing member.

7. The apparatus of claim 1, wherein each of the at least two spacing members has a locking mechanism for holding the spacing member in an extended position of a predetermined length.

8. The apparatus of claim 1, further comprising a quick release mechanism for connecting the rotating joint member having:

a male insertion structure in at least one of said attachment members having a first shape, and a female receiver position on said anchoring device, wherein said male insertion structure includes a male pin that engages with said female receiver.

9. The apparatus of claim 8, wherein said rotatable joint member is a ball joint, wherein said ball joint includes a pin passage through the ball structure for receiving said male pin.

10. The apparatus of claim 9, wherein said ball joint includes at least one joint spacer positioned on the ball that limits motion of the rotational joint within said receiver to a range of angles of about 5° to about 30° relative to a perpendicular from an outer surface of the anchoring device.

11. The apparatus of claim 1, wherein said anchoring device has a recessed bracket into which the rotating joint member is inserted, and an outer cover plate that is flush with an outer surface of the watercraft.

12. A mooring apparatus comprising:

i. a first spacing member with first and second opposite ends, and a second spacing member with first and second opposite ends, wherein each of said first and second spacing members has an adjustable length;

ii. a plurality of attachment members each having a rotatable joint, with at least one attachment member attached to each of the first and second opposite ends of each of the first and second spacing members, wherein the plurality of attachment members are releasably attachable to an anchoring device in a watercraft;

iii. a first tensioning member for connecting a first end of the first spacing member with a second end of the second spacing member and a second tensioning member for connecting a second end of the first spacing member with a first end of the second spacing member, wherein said first and second spacing members are operable to be extended from a first length to a second length to apply tension to said first and second tensioning members to cross-brace the first and second spacing members; and iv. a plurality of anchoring devices, each having a recessed bracket into which the rotational joint is inserted.

13. The apparatus of claim 12, wherein the first and second spacing members are separated by a pre-determined distance.

14. The apparatus of claim 12, wherein at least one of the first and second spacing member includes at least two coaxial telescoping sections that slide past each to extend or retract the length of the at least one of the first and second spacing member.

15. The apparatus of claim 12, wherein at least one of the first and second spacing member has a locking mechanism for holding the at least one of first and second spacing member in an extended position of a pre-determined length.

16. The apparatus of claim 12, further comprising a quick release mechanism having:

a male insertion structure in at least one of said attachment members having a first shape, and a female receiver for anchoring the spacing member to the anchoring device, wherein said anchoring device is operable to be attached to a hull of a boat or a dock, wherein said male insertion structure includes a male pin that engages with said female receiver.

17. The apparatus of claim 12, wherein each of said anchoring devices has an outer cover plate that is flush with an outer surface of the watercraft.

18. A method of attaching a watercraft to a second watercraft or stationary structure, comprising:

i. inserting a rotatable joint positioned at a first end of a first spacer into a receiver in an anchoring device installed in the surface of a first watercraft;

ii. reversibly locking said rotatable joint into said receiver, wherein said rotatable joint allows for limited rotational motion to allow the first watercraft to oscillate with the motion of the surface of water;

iii. connecting a second end of said first spacer to said second watercraft or stationary structure to secure said watercraft to said second watercraft or stationary structure;

iv. connecting a second spacer to said first watercraft and said second watercraft or stationary structure;

v. connecting a first tensioning member to the first end of the first spacer and a second end of said second spacer;

vi. connecting a second tensioning member to the second end of the first spacer and a first end of said second spacer; and vii. applying tension to said first and second tensioning members by extending lengths of the first and second spacers.

19. The method of claim 18, wherein said rotatable joint is a ball joint, wherein said ball joint includes a pin passage through the ball structure for receiving a male pin.

20. The method of claim 19, wherein said ball joint includes at least one joint spacer positioned on the ball that limits motion of the rotational joint within said receiver to a range of angles of about 5° to about 30° relative to a perpendicular from an outer surface of the anchoring device.

* * * * *